US010109450B2

(12) United States Patent
Virshup et al.

(10) Patent No.: US 10,109,450 B2
(45) Date of Patent: Oct. 23, 2018

(54) X-RAY TUBE WITH STRUCTURALLY SUPPORTED PLANAR EMITTER

(71) Applicant: VAREX IMAGING CORPORATION, Salt Lake City, UT (US)

(72) Inventors: Gary F. Virshup, Cupertino, CA (US); James R. Boye, Salt Lake City, UT (US); Michael C. Green, Palo Alto, CA (US); David H. Humber, Los Gatos, CA (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 260 days.

(21) Appl. No.: 15/074,834

(22) Filed: Mar. 18, 2016

(65) Prior Publication Data

US 2017/0271116 A1 Sep. 21, 2017

(51) Int. Cl.
*H01J 35/06* (2006.01)

(52) U.S. Cl.
CPC ..... *H01J 35/06* (2013.01)

(58) Field of Classification Search
CPC .. H01J 35/00; H01J 35/02; H01J 35/06; H01J 35/065; H01J 35/14; H01J 35/16; H01J 2235/00; H01J 2235/06; H01J 2235/062; H01J 2235/068
USPC ..... 378/121, 122, 136
See application file for complete search history.

(56) References Cited

U.S. PATENT DOCUMENTS

| | | | | |
|---|---|---|---|---|
| 4,344,011 | A * | 8/1982 | Hayashi | H01J 35/06 313/453 |
| 4,698,835 | A * | 10/1987 | Ono | H01J 35/06 313/453 |
| 6,259,193 | B1 * | 7/2001 | Lipkin | H01J 1/18 313/271 |
| 7,924,983 | B2 | 4/2011 | Moore | |
| 8,077,829 | B2 | 12/2011 | Moore et al. | |
| 2014/0239799 | A1 | 8/2014 | Freudenberger | |

(Continued)

FOREIGN PATENT DOCUMENTS

| | | |
|---|---|---|
| EP | 0164665 A1 | 12/1985 |
| WO | 2015/066246 | 5/2015 |

OTHER PUBLICATIONS

International Search Report and Written Opinion, as issued in connection with International Patent Application No. PCT/US2017/022775, dated Jul. 4, 2017, 11 pgs.

*Primary Examiner* — Jurie Yun
(74) *Attorney, Agent, or Firm* — Maschoff Brennan

(57) ABSTRACT

A cathode head can include: an insulating member on a base; an electron emitter with a planar emitter surface formed by a plurality of elongate rungs connected together through a plurality of turns from a first emitter end to a second emitter end so as to form a serpentine emitter pattern; a plurality of elongate legs extending from the plurality of turns at an angle relative to the planar emitter surface, each of the legs being coupled with the insulating member; an elongate first lead leg at the first emitter end and an elongate second lead leg at the second emitter end; a first electrical lead and a second electrical lead extending from the base; and a first electrical coupler coupling the first electrical lead to the first lead leg and a second electrical coupler coupling the second electrical lead to the second lead leg.

21 Claims, 15 Drawing Sheets

(56) References Cited

U.S. PATENT DOCUMENTS

| | | | |
|---|---|---|---|
| 2015/0187530 | A1 | 7/2015 | Canfield et al. |
| 2015/0187536 | A1 | 7/2015 | Canfield et al. |
| 2015/0187537 | A1 | 7/2015 | Canfield |
| 2015/0187538 | A1 | 7/2015 | Canfield et al. |

* cited by examiner

X-RAY TUBE WITH STRUCTURALLY SUPPORTED PLANAR EMITTER

BACKGROUND

X-ray tubes are used in a variety of industrial and medical applications. For example, X-ray tubes are employed in medical diagnostic examination, therapeutic radiology, semiconductor fabrication, and material analysis. Regardless of the application, most X-ray tubes operate in a similar fashion. X-rays, which are high frequency electromagnetic radiation, are produced in X-ray tubes by applying an electrical current to a cathode to cause electrons to be emitted from the cathode by thermionic emission. The electrons accelerate towards and then impinge upon an anode. The distance between the cathode and the anode is generally known as A-C spacing or throw distance. When the electrons impinge upon the anode, the electrons can collide with the anode to produce X-rays. The area on the anode in which the electrons collide is generally known as a focal spot.

X-rays can be produced through at least two mechanisms that can occur during the collision of the electrons with the anode. A first X-ray producing mechanism is referred to as X-ray fluorescence or characteristic X-ray generation. X-ray fluorescence occurs when an electron colliding with material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second X-ray producing mechanism is referred to as Bremsstrahlung. In Bremsstrahlung, electrons emitted from the cathode decelerate when deflected by nuclei of the anode. The decelerating electrons lose kinetic energy and thereby produce X-rays. The X-rays produced in Bremsstrahlung have a spectrum of frequencies. The X-rays produced through either Bremsstrahlung or X-ray fluorescence may then exit the X-ray tube to be utilized in one or more of the above-mentioned applications.

In certain applications, it may be beneficial to lengthen the throw length of an X-ray tube. The throw length is the distance from cathode electron emitter to the anode surface. For example, a long throw length may result in decreased back ion bombardment and evaporation of anode materials back onto the cathode. While X-ray tubes with long throw lengths may be beneficial in certain applications, a long throw length can also present difficulties. For example, as a throw length is lengthened, the electrons that accelerate towards an anode through the throw length tend to become less laminar resulting in an unacceptable focal spot on the anode. Also affected is the ability to properly focus and/or position the electron beam towards the anode target, again resulting in a less than desirable focal spot—either in terms of size, shape and/or position. When a focal spot is unacceptable, it may be difficult to produce useful X-ray images.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

Disclosed embodiments address these and other problems by improving X-ray image quality via improved electron emission characteristics, and/or by providing improved control of a focal spot size and position on an anode target. This helps to increase spatial resolution or to reduce artifacts in resulting images.

In one embodiment, an electron emitter can include: an emitter body having a planar emitter surface formed by a plurality of elongate rungs connected together through a plurality of turns from a first emitter end to a second emitter end with each turn connecting adjacent ends of two corresponding rungs so as to form a serpentine emitter pattern; and a plurality of elongate legs extending from the plurality of turns.

In one embodiment, an electron emitter assembly can include: an insulating member; and an electron emitter with an emitter body having a planar emitter surface formed by a plurality of elongate rungs connected together through a plurality of turns from a first emitter end to a second emitter end so as to form a serpentine emitter pattern, and having a plurality of elongate legs extending from the plurality of turns at an angle relative to the planar emitter surface, each of the legs being coupled with the insulating member.

In one embodiment, a cathode head can include: a base; and an electron emitter assembly coupled with the base. The electron emitter assembly can include: an insulating member on the base; and an electron emitter with an emitter body having a planar emitter surface formed by a plurality of elongate rungs connected together through a plurality of turns from a first emitter end to a second emitter end so as to form a serpentine emitter pattern, and having a plurality of elongate legs extending from the plurality of turns at an angle relative to the planar emitter surface, each of the legs being coupled with the insulating member, an elongate first lead leg at the first emitter end and an elongate second lead leg at the second emitter end, wherein the insulating member insulates the electron emitter from the base. The cathode head can also include: a first electrical lead and a second electrical lead extending from the base; and a first electrical coupler coupling the first electrical lead to the first lead leg and a second electrical coupler coupling the second electrical lead to the second lead leg.

In yet another embodiment, an electron source is provided in the form of a flat emitter for the production of electrons. The emitter has a relatively large emitting area with design features that can be tuned to produce the desired distribution of electrons to form a primarily laminar beam. The emission over the emitter surface is not uniform or homogenous; it is tuned to meet the needs of a given application. As the beam flows from the cathode to the anode, the electron density of the beam spreads the beam apart significantly during transit. The increased beam current levels created by higher power requirements exacerbate the spreading of the beam during transit. In disclosed embodiments, to achieve the focal spot sizes required, the beam is focused by two quadrupoles as it transits from the cathode to the anode. This also provides for creating a multiplicity of sizes from a single emitter; the size conceivably could be changed during an exam as well. The increased emitter area of the flat geometry of the emitter allows production of sufficient electrons flowing laminarly to meet the power requirements. To address the requirement of steering the beam in two dimensions so as to provide the desired imaging enhancements, a pair of dipoles is used to deflect the beam to the desired positions at the desired time. One dipole set is provided for each direction.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1A:
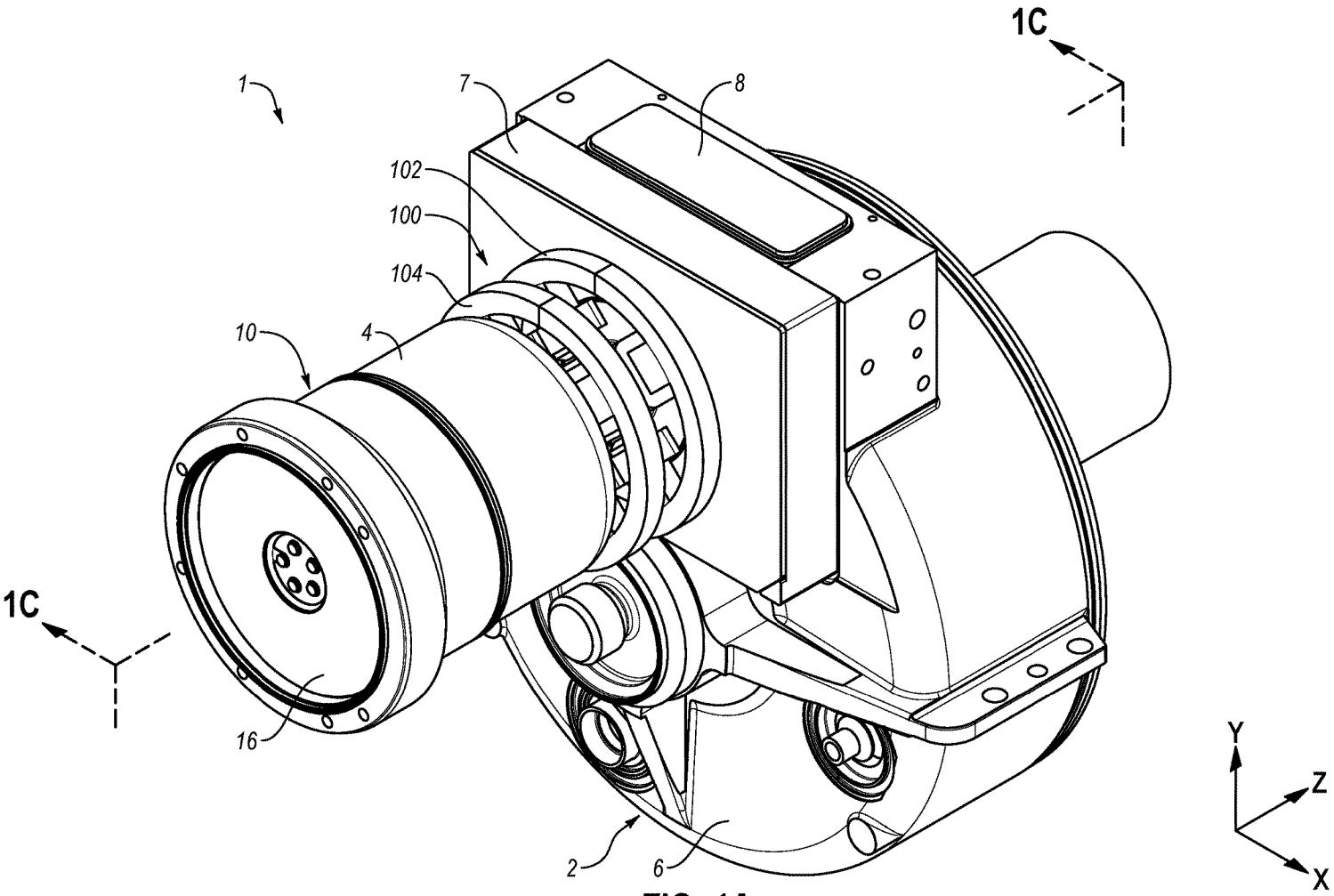
FIG. 1A is a perspective view of an example X-ray tube in which one or more embodiments described herein may be implemented.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. General Overview of an Exemplary X-Ray Tube

Embodiments of the present technology are directed to X-ray tubes of the type having a vacuum housing in which a cathode and an anode are arranged. The cathode includes a structurally stabilized electron emitter with a planar emitting surface that emits electrons in the form of an electron beam that is substantially perpendicular to the planar face of the emitter, and the electrons are accelerated due to a voltage difference between the cathode and the anode so as to strike a target surface on the anode in an electron region referred to as a focal spot.

Figure 1B:
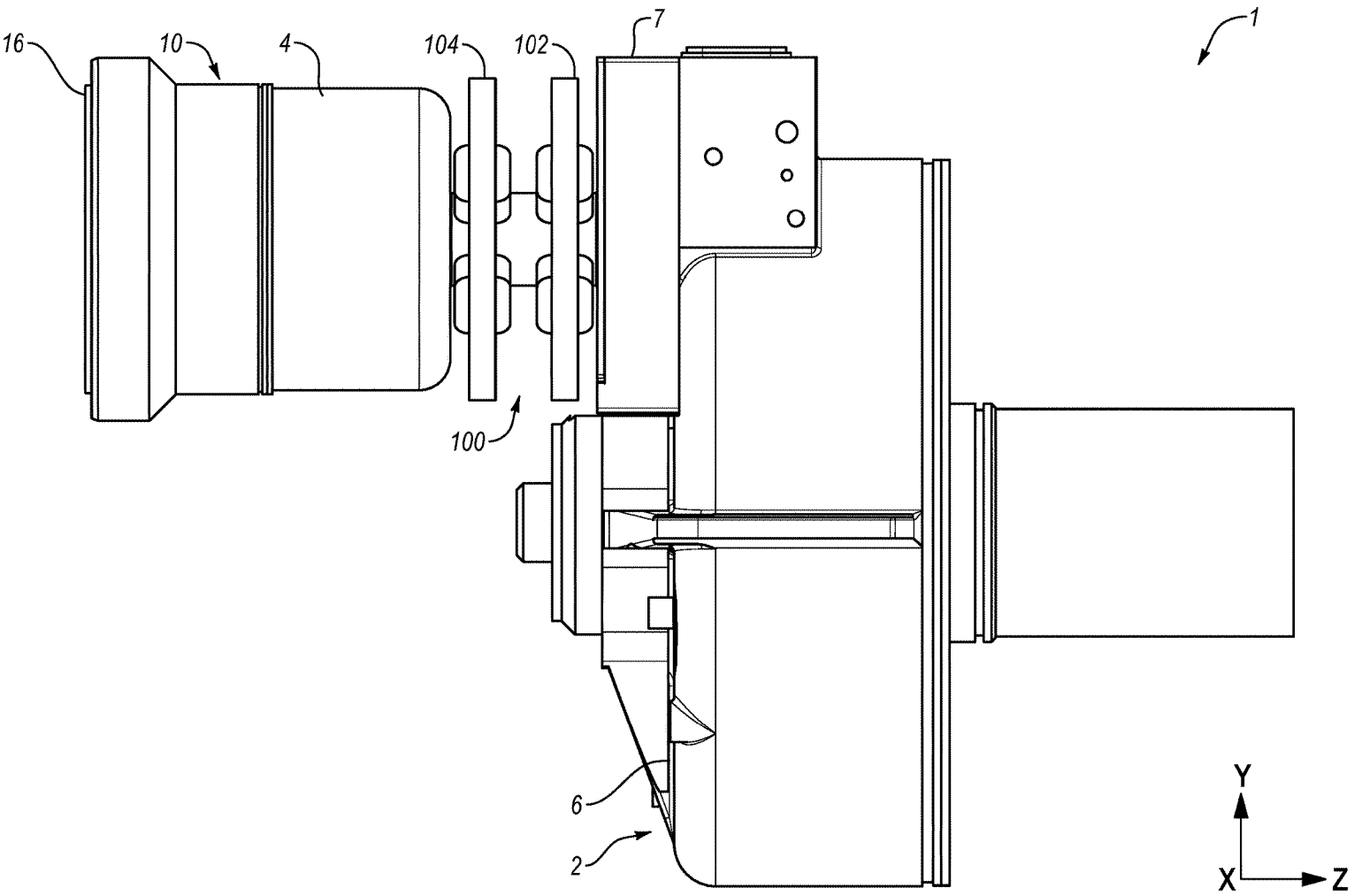
FIG. 1B is a side view of the X-ray tube of FIG. 1A.
Figure 1C:
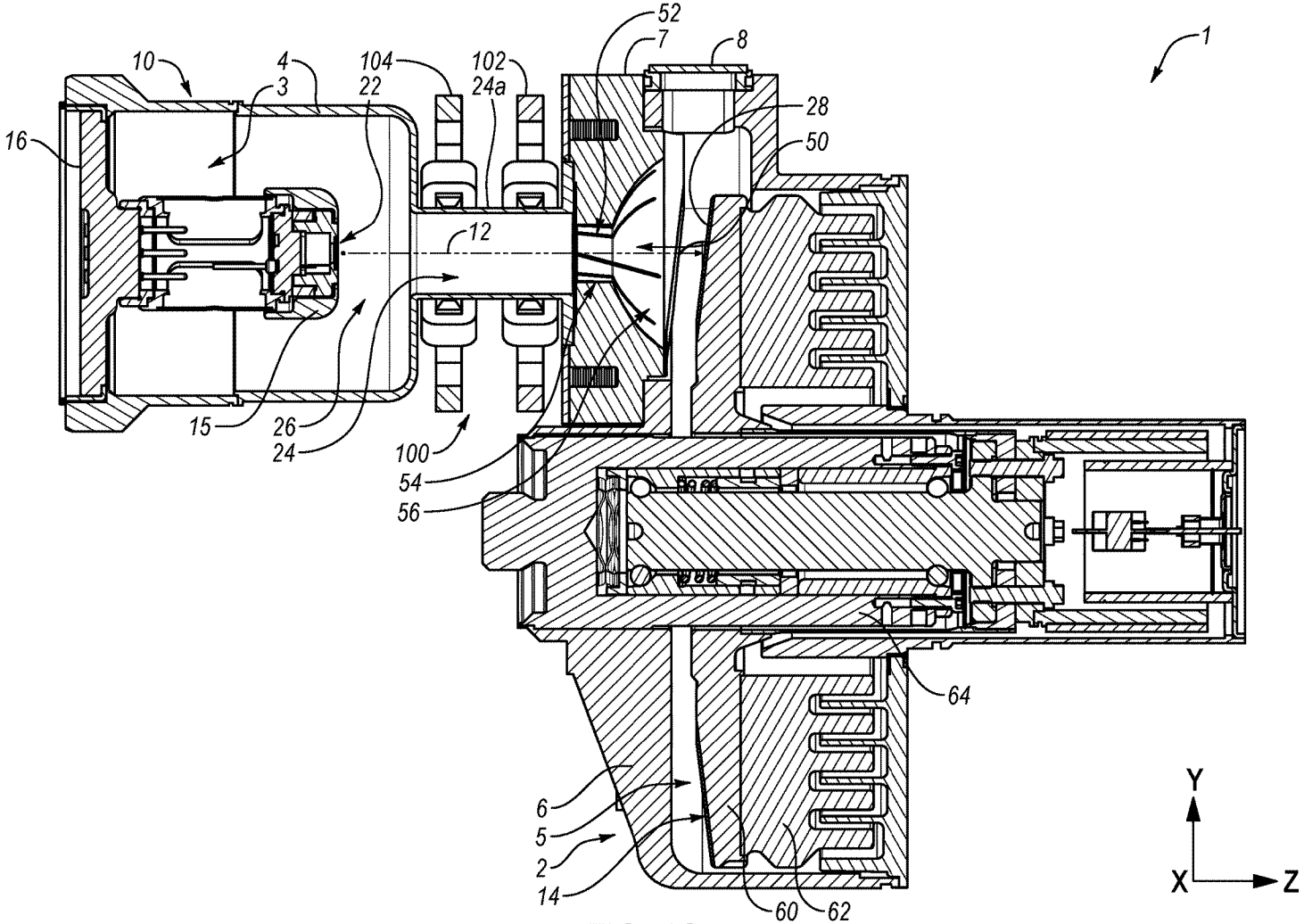
FIG. 1C is a cross-sectional view of the X-ray tube of FIG. 1A.

Disclosed embodiments illustrate a stabilized electron emitter having a planar electron emitter structure. Moreover, the stabilized emitter is designed and configured to provide tunable emission characteristics for the emitted electron beam, which results in the ability to tailor—and thus optimize—the focal spot size, shape and position for a given imaging application. The tailoring of the stabilized electron emitter that has a planar emitting surface results in an enhanced emitter configuration that avoids image quality issues due to a less-than-optimal focal spot. For example, an increase in spatial resolution and reduction in image artifacts is possible with the designed planer electron emitter patterns. One example of an X-ray tube having certain of these features—discussed in further detail below—is shown in FIGS. 1A-1C. However, the stabilized emitter described herein can be used in various X-ray tube embodiments, such as those with or without beam focusing and/or steering.

In general, example embodiments described herein relate to a cathode assembly with a stabilized electron emitter with a planar emitting surface that can be used in substantially any X-ray tube, such as, for example, in long throw length X-ray tubes. In at least some of the example embodiments disclosed herein, the difficulties associated with a long throw length of an X-ray tube can be overcome by employing a stabilized electron emitter having a planar emitting surface that is structurally stabilized in order to inhibit curling or other deformation of the planar emitting surface. In a disclosed embodiment, the planar emitting surface can be formed by a continuous and cutout shaped planar member with a substantially flat emitting surface that extends between two electrodes. The continuous flat emitting surface can have a plurality of sections connected together at bends or elbows that are defined by the cutout. When a suitable electrical current is passed through the emitter, the planar emitting surface emits electrons that form an electron beam that is substantially laminar as it propagates through an acceleration region and a drift region (e.g., with or without magnetic steering or focusing) to impinge upon a target surface of an anode at a focal spot.

FIGS. 1A-1C are views of one example of an X-ray tube 1 in which one or more embodiments of a stabilized electron emitter described herein may be implemented. Specifically, FIG. 1A depicts a perspective view of the X-ray tube 1 and FIG. 1B depicts a side view of the X-ray tube 1, while FIG. 1C depicts a cross-sectional view of the X-ray tube 1. The X-ray tube 1 illustrated in FIGS. 1A-1C represents an example operating environment and is not meant to limit the embodiments described herein.

Generally, X-rays are generated within the X-ray tube 1, some of which then exit the X-ray tube 1 to be utilized in one or more applications. The X-ray tube 1 may include a vacuum enclosure structure 2 which may act as the outer structure of the X-ray tube 1. The vacuum enclosure structure 2 may include a cathode housing 4 and an anode housing 6. The cathode housing 4 may be secured to the anode housing 6 such that an interior cathode volume 3 is defined by the cathode housing 4 and an interior anode volume 5 is defined by the anode housing 6, each of which are joined so as to define the vacuum enclosure structure 2.

In some embodiments, the vacuum enclosure structure 2 is disposed within an outer housing (not shown) within which a coolant, such as liquid or air, is circulated so as to dissipate heat from the external surfaces of the vacuum enclosure structure 2. An external heat exchanger (not shown) is operatively connected so as to remove heat from the coolant and recirculate it within the outer housing.

The X-ray tube 1 depicted in FIGS. 1A-1C includes a shield component (sometimes referred to as an electron shield, aperture, or electron collector) 7 that is positioned between the anode housing 6 and the cathode housing 4 so as to further define the vacuum enclosure structure 2. The cathode housing 4 and the anode housing 6 may each be welded, brazed, or otherwise mechanically coupled to the shield component 7 having an electron path 52. While other configurations can be used, examples of suitable shield implementations are further described in U.S. patent application Ser. No. 13/328,861 filed Dec. 16, 2011 and entitled "X-ray Tube Aperture Having Expansion Joints," and U.S. Pat. No. 7,289,603 entitled "Shield Structure And Focal Spot Control Assembly For X-ray Device," the contents of each of which are incorporated herein by reference for all purposes.

The X-ray tube 1 may also include an X-ray transmissive window 8. Some of the X-rays that are generated in the X-ray tube 1 may exit through the window 8. The window 8 may be composed of beryllium or another suitable X-ray transmissive material.

With specific reference to FIG. 1C, the cathode housing 4 forms a portion of the X-ray tube 1 referred to as a cathode assembly 10. The cathode assembly 10 generally includes components that relate to the generation of electrons that together form an electron beam, denoted at 12. The cathode assembly 10 may also include the components of the X-ray tube 1 between an end 16 of the cathode housing 4 and an anode 14. For example, the cathode assembly 10 may include a cathode head 15 having a structurally stabilized electron emitter, generally denoted at 22, disposed at an end of the cathode head 15. As will be further described, in disclosed embodiments the electron emitter 22 is configured as a structurally stabilized electron emitter with a planar emitting surface that has been stabilized to inhibit warping, curling, or other deformation of the planar emitting surface. When an electrical current is applied to the electron emitter 22, the electron emitter 22 is configured to emit electrons via thermionic emission from the planar emitting surface, that together form a laminar electron beam 12 that accelerates towards the anode target 28.

The cathode assembly 10 may additionally include an acceleration region 26 further defined by the cathode housing 4 and adjacent to the electron emitter 22. The electrons emitted by the electron emitter 22 form an electron beam 12 and enter traverse through the acceleration region 26 and accelerate towards the anode 14 due to a suitable voltage differential. More specifically, according to the arbitrarily-defined coordinate system included in FIGS. 1A-1C, the electron beam 12 may accelerate in a z-direction, away from the electron emitter 22 in a direction through the acceleration region 26.

The cathode assembly 10 may additionally include at least part of a drift region 24 defined by a neck portion **24*a* of the cathode housing 4. In this and other embodiments, the drift region 24 may also be in communication with an aperture 50 provided by the shield 7, thereby allowing the electron beam 12 emitted by the electron emitter 22 to propagate through the acceleration region 26, the drift region 24 and aperture 50 until striking the anode target surface 28. In the drift region 24, a rate of acceleration of the electron beam 12 may be reduced from the rate of acceleration in the acceleration region 26. As used herein, the term "drift" describes the propagation of the electrons in the form of the electron beam 12 through the drift region 24**.

Positioned within the anode interior volume 5 defined by the anode housing 6 is the anode 14, denoted generally at 14. The anode 14 is spaced apart from and opposite to the cathode assembly 10 at a terminal end of the drift region 24. Generally, the anode 14 may be at least partially composed of a thermally conductive material or substrate, denoted at 60. For example, the conductive material may include tungsten or molybdenum alloy. The backside of the anode substrate 60 may include additional thermally conductive material, such as a graphite backing, denoted by way of example here at 62.

The anode 14 may be configured to rotate via a rotatably mounted shaft, denoted here as 64, which rotates via an inductively induced rotational force on a rotor assembly via ball bearings, liquid metal bearings or other suitable structure. As the electron beam 12 is emitted from the electron emitter 22, electrons impinge upon a target surface 28 of the anode 14. The target surface 28 is shaped as a ring around the rotating anode 14. The location in which the electron beam 12 impinges on the target surface 28 is known as a focal spot (not shown). Some additional details of the focal spot are discussed below. The target surface 28 may be composed of tungsten or a similar material having a high atomic ("high Z") number. A material with a high atomic number may be used for the target surface 28 so that the material will correspondingly include electrons in "high" electron shells that may interact with the impinging electrons to generate X-rays in a manner that is well known.

During operation of the X-ray tube 1, the anode 14 and the electron emitter 22 are connected in an electrical circuit. The electrical circuit allows the application of a high voltage potential between the anode 14 and the electron emitter 22. Additionally, the electron emitter 22 is connected to a power source such that an electrical current is passed through the electron emitter 22 to cause electrons to be generated by thermionic emission. The application of a high voltage differential between the anode 14 and the electron emitter 22 causes the emitted electrons to form an electron beam 12 that accelerates through the acceleration region 26 and the drift region 24 towards the target surface 28. Specifically, the high voltage differential causes the electron beam 12 to accelerate through the acceleration region 26 and then drift through the drift region 24. As the electrons within the electron beam 12 accelerate, the electron beam 12 gains kinetic energy. Upon striking the target surface 28, some of this kinetic energy is converted into electromagnetic radiation having a high frequency, i.e., X-rays. The target surface 28 is oriented with respect to the window 8 such that the X-rays are directed towards the window 8. At least some portion of the X-rays then exit the X-ray tube 1 via the window 8.

Optionally, one or more electron beam manipulation components can be provided. Such devices can be implemented so as to "steer" and/or "deflect" the electron beam 12 as it traverses the drift region 24, thereby manipulating or "toggling" the position of the focal spot on the target surface 28. Additionally or alternatively, a manipulation component can be used to alter or "focus" the cross-sectional shape of the electron beam and thereby change the shape of the focal spot on the target surface 28. In the illustrated embodiments electron beam focusing and steering are provided by way of a magnetic system denoted generally at 100.

The magnetic system 100 can include various combinations of quadrupole and/or dipole implementations that are disposed so as to impose magnetic forces on the electron beam so as to steer and/or focus the beam. One example of the magnetic system 100 is shown in FIGS. 1A-1C. In this embodiment, the magnetic system 100 is implemented as magnetic quadrupoles and/or magnetic dipoles disposed in the electron beam 12 path of the X-ray tube. The quadrupoles and/or dipoles are configured to (a) focus in both directions perpendicular to the beam path, and (b) to steer the beam in both directions perpendicular to the beam path. In this way, the quadrupoles and/or dipoles act together to form a magnetic lens (sometimes referred to as a "doublet"), and the focusing and steering is accomplished as the electron beam 12 passes through the quadrupole and/or dipole "lens." The "focusing" provides a desired focal spot shape and size, and the "steering" effects the positioning of the focal spot on the anode target surface 28. Each quadrupole or dipole is implemented with a core section, or a yoke, denoted as a cathode core at 104, and an anode core at 102. Each core can have a quadrupole or two dipoles or both a quadrupole and dipoles.

FIG. 1C shows a cross-sectional view of an embodiment of a cathode assembly 10 that can be used in the X-ray tube 1 with the stabilized electron emitter 22 and magnetic system 100 described herein. As illustrated, a throw path between the electron emitter 22 and target surface 28 of the anode 14 can include the acceleration region 26, drift region 24, and aperture 50 formed in shield 7. In the illustrated embodiment, the shield 7 includes the electron path 52 through the aperture 50 that is formed via aperture neck 54 and an expanded electron collection surface 56 that is oriented towards the anode 14.

Figure 2A:
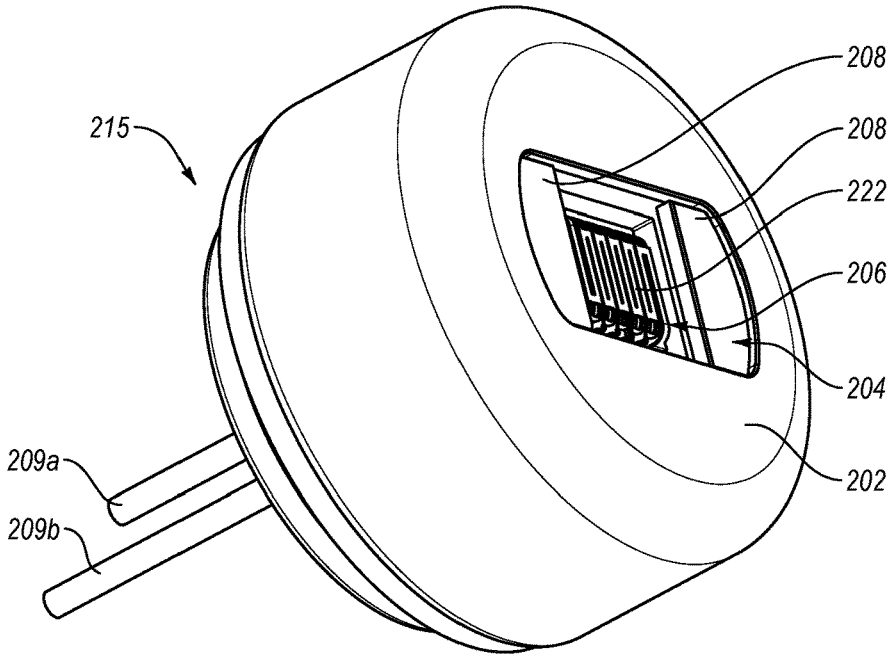
FIG. 2A is a perspective view of an example cathode head having a cathode shield.

FIG. 2A shows the components of the X-ray device that are arranged for electron emission, electron beam steering or focusing, and X-ray emission. The cathode head 215 is shown with the stabilized electron emitter 222 oriented so as to emit electrons in a beam 12 towards the anode 14. The cathode head 215 and stabilized electron emitter 222 can be the cathode head 15 and electron emitter 22 of FIGS. 1A-1C.

II. Example Embodiments of a Planar Emitter with Tunable Emission Characteristics FIG. 2A illustrates a cathode head 215 with a stabilized electron emitter 222 (e.g., "stabilized emitter"). The cathode head 215 is a portion of the cathode assembly 10 illustrated in FIGS. 1A-1C. The cathode head 215 is positioned so that the stabilized emitter 222 is oriented or pointed toward the anode 14 (see FIG. 1C for orientation). The cathode head 215 is shown to have a cathode shield 202 that has a shield aperture 204 that opens into a shield cavity 206 that contains the stabilized emitter 222. Beam focusing elements 208 are shown on opposite sides of the stabilized emitter 222. Electrical leads 209*a*, 209*b* are also shown, which are electrically coupled with the stabilized emitter 222.

Figure 2B:
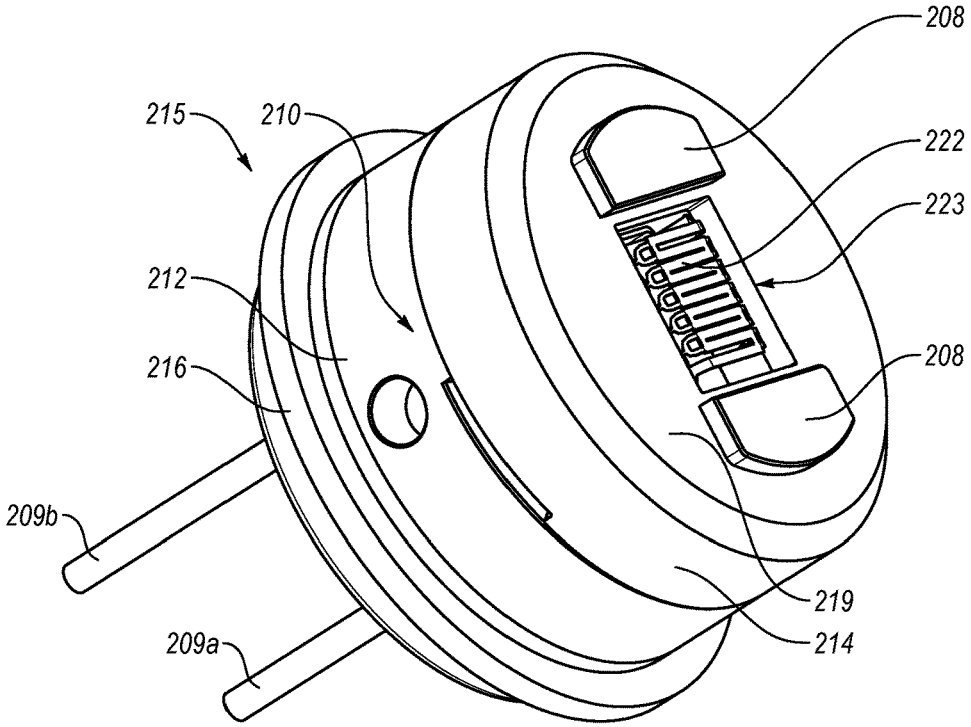
FIG. 2B is a perspective view of the cathode head of FIG. 2A without the cathode shield.

FIG. 2B illustrates the cathode head 215 that has the cathode shield 202 removed, where the cathode head 215 is rotated relative to FIG. 2A. The cathode head 215 can include a head surface 219 that has an emitter region that is formed as a recess 223 in head surface 219 that is configured to receive the stabilized emitter 222. The head surface 219 is shown to have the electron beam focusing elements 208 located on opposite sides of the stabilized emitter 222.

FIG. 2B also shows the cathode head 215 to have an emitter height adjustment mechanism 210, which includes a rotating member 212 and an elevating member 214. Rotation of the rotating member 212 in one direction elevates the stabilized emitter 222 relative to the head surface 219, and rotation of the rotating member 212 in the other direction sinks the stabilized emitter 222 relative to the head surface 219. The raising of the stabilized emitter 222 can be by the cathode head surface 219 sinking relative to the stabilized emitter 222. That is, the stabilized emitter 222 can be attached to the base 216, and the elevating member 214 raises the head surface 219 relative to the stabilized emitter 222. The sinking of the stabilized emitter 222 can be by the cathode head surface 219 raising relative to the stabilized emitter 222. That is, the stabilized emitter 222 can be attached to the base 216, and the elevating member 214 sinks the surface 219 relative to the stabilized emitter 222. The rising and sinking of the stabilized emitter 222 by the adjustment mechanism 210 can be relative to the head surface 219 such that the stabilized emitter 222 says fixed and the head surface 219 moves, or the stabilized emitter 222 can be raised or lowered relative to the head surface 219 that is fixed. As such, the stabilized emitter 222 can be elevated or sunk relative to a recess 223 in the surface 219, where the recess 223 can be shaped and dimensioned to accommodate the stabilized emitter 222 therein. The elevating member 214 may rise or lower while the stabilized emitter 222 stays at a fixed height. However, a modification can be the rotation of an elevating member 214 elevating the stabilized emitter 222 up or down and the head surface 219 staying at a fixed height. In one option, once the relative height of the stabilized emitter 222 and head surface 219 is determined, the relative height can be fixed.

Figure 2C:
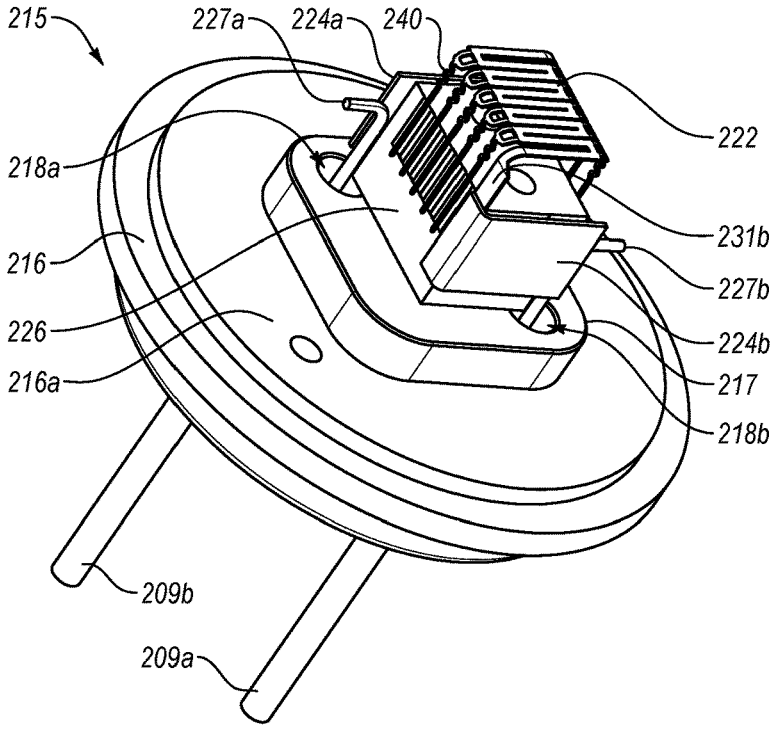
FIG. 2C is a perspective view of an internal region of the cathode head of FIG. 2A that has a stabilized electron emitter with a planar emitting surface.

FIG. 2C illustrates an embodiment of an internal region of the cathode head 215 that shows electrical leads 227*a*, 227*b* for the stabilized electron emitter 222. As shown, the base 216 can be dimensioned to receive the adjustment mechanism 210 and cathode shield 202 thereover. The base 216 can include a lead housing 217 protruding from a base surface 216*a*. The lead housing 217 can include a first lead receptacle 218*a* and second lead receptacle 218*b* formed therein. The first lead receptacle 218*a* houses the first lead 227*a*, and the second lead receptacle 218*b* houses the second lead 227*b*. The first lead 227*a* is electrically coupled via an electrical coupler 224*a* to a first lead leg 231*a* (shown in FIG. 3A), and the second lead 227*b* is electrically coupled via an electrical coupler 224*b* to a second lead leg 231*b*. The electrical coupling may be structurally reinforced with a mechanical coupling between the leads 227*a*, 227*b* and electrical couplers 224*a*, 224*b* and with the lead legs 231*a*, 231*b*. The mechanical coupling can be by welding, brazing, adhesive, mechanical coupling or other coupling that keeps the first and second leads 227*a*, 227*b* physically and mechanically coupled with the electrical couplers 224*a*, 224*b* and with the corresponding first and second lead legs 231*a*, 231*b*. The first and second leads 227*a*, 227*b* can be electrically connected to the cathode assembly 10 as known in the art and to cathode electrical leads 209*a*, 209*b*. The stabilized emitter 222 is also shown to be attached to an insulating block 226 via stabilizer legs 240.

Figure 3A:
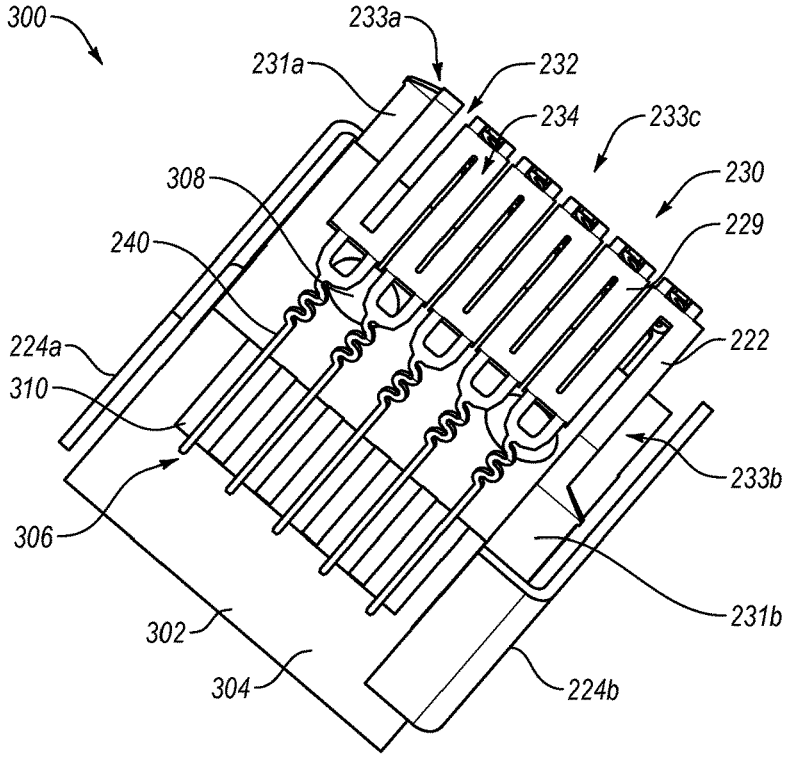
FIGS. 3A-3B are different perspective views that illustrate example embodiments of an emitter block that has a stabilized emitter located on an insulating block.
Figure 3B:
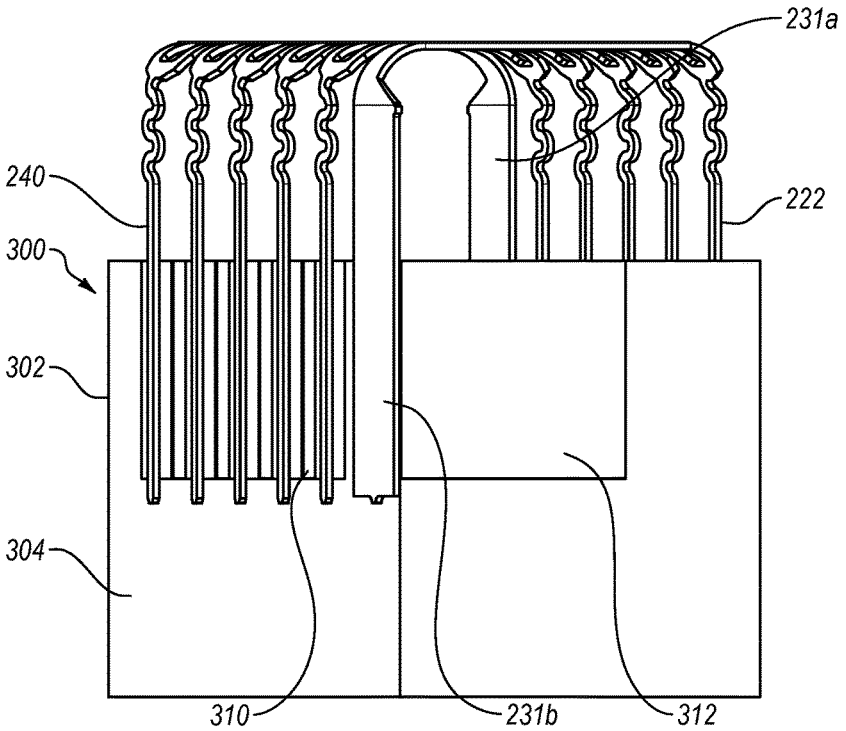

FIGS. 3A-3B illustrate an embodiment of an emitter block 300 that has the stabilized emitter 222 located on an insulating block 302. The insulating block 302 can be prepared from any electrically and/or thermally insulating material, such as ceramic, and can be in any suitable shape. The stabilized emitter 222 includes an emitter body 229 that is continuous from the first electrical coupler 224*a* to the second electrical coupler 224*b* and forms an emitter pattern 230 (e.g., serpentine pattern). The emitter pattern 230 can be two-dimensional so as to form a planar emitter surface 234, where different regions of the emitter body 229 cooperate to form the planar emitter surface 234. There are gaps 232 (e.g., illustrated by spaces between members) between different regions of the emitter body 229. The planar emitter surface 234 is shown to be rectangular with a serpentine pattern that is shaped by the gaps 232, and has a first end 233*a* to a middle region 233*c* to a second end 233*b*. As illustrated, the middle region 233*c* of the planar emitter surface 234 is also the middle region of the stabilized emitter 222 and middle region of the emitter body 229 and the emitter pattern 230. However, other arrangements, configurations, or patterns may be implemented to a stabilized emitter 222 so as to have a planar emitter surface 234. The stabilized emitter 222 includes stabilizer legs 240 (e.g., legs) attached to the planar emitter surface 234. The other end of the legs 240 are coupled to the insulating block 302. The insulating block 302 can have the legs 240 of the stabilized emitter 222 coupled directly to the external surface 304, or in receiving grooves 306 or receiving apertures (not shown) that can be formed into the insulating block 302 and dimensioned to receive the legs 240. The insulating block 302 can have bond pads 310 that can be electronically and mechanically (e.g., via weld, braze, etc.) attached to the legs 240. The insulating block 302 can also include through holes 308 that can be used to receive fasteners to fasten the insulating block 302 to the cathode head 215 or used to align the insulating block 302 relative to the cathode head 215. The insulating block 302 can optionally include contact pads 312 that can be electronically and mechanically (e.g., via weld, braze, etc.) attached to the lead legs 231*a*, 231*b*. The contact pads 312 can be electrically coupled to the first and second leads 227*a*, 227*b* by any suitable electrical connector.

The legs 240 can be mechanically attached to the insulating block 302 by any way possible. This can include the legs 240 being soldered, brazed, adhered with adhesive, or otherwise connected to the insulating block 302. In one example, the legs 240 can be attached by an outside braze to the ceramic insulating block 302. As such, the legs 240 provide structural support to the stabilized emitter 222, and are insulated from each other and from the electrical leads, except for the ring and turns that connect the legs 240. The bond pads 310 are also insulated from each other and from the contact pads 312.

FIG. 2C in view of FIGS. 3A-3B shows that the first lead 227*a* can be coupled to a first lead leg 231*a* at the first end 233*a* of the emitter body 229 and the second lead 227*b* can be coupled a second lead leg 231*b* at the second end 233*b* of the emitter body 229. As shown, the first lead leg 231*a* is opposite of the second lead leg 231*b*; however, in some configurations the first lead leg 231*a* may be adjacent or proximal of the second lead leg 231*b* or at any point on the emitter pattern 230.

Figure 4:
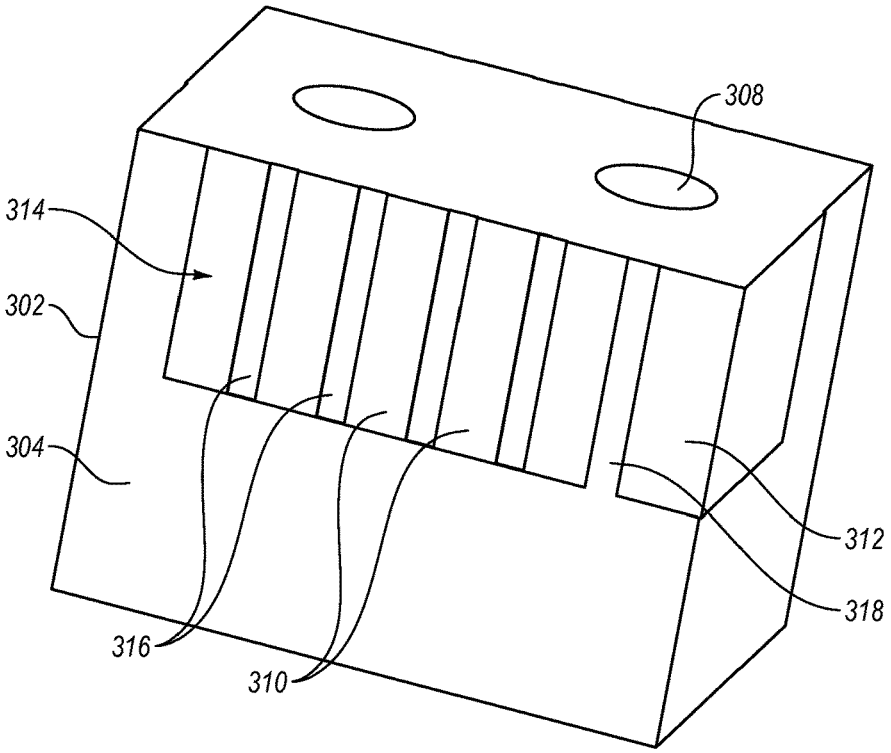
FIG. 4 is a perspective view of an example of an insulating block.

FIG. 4 illustrates an embodiment of an insulating block 302. The external surface 304 is shown to have the bond pads 310 and contact pads 312, which is duplicated on the opposite side. The contact pads 312 are shown to form around the corner. The bond pads 310 may be fit into a recess 314 on the external surface 304 or located on the external surface 304. The recess 314 results in a bond gap 316 between each bond pad 310, where the bond gap 316 electrically and/or thermally isolates the bond pads 310 from each other, and thereby electrically and/or thermally isolates the legs 240 from each other. There is a contact gap 318 between the contact pads 312 and the bond pads 310 to electrically and/or thermally isolate the contact pads 312 from the bond pads 310. However, the bond pads 310 and contact pads 312 may be attached to the external surface 304 so as to protrude therefrom.

Figure 5A:
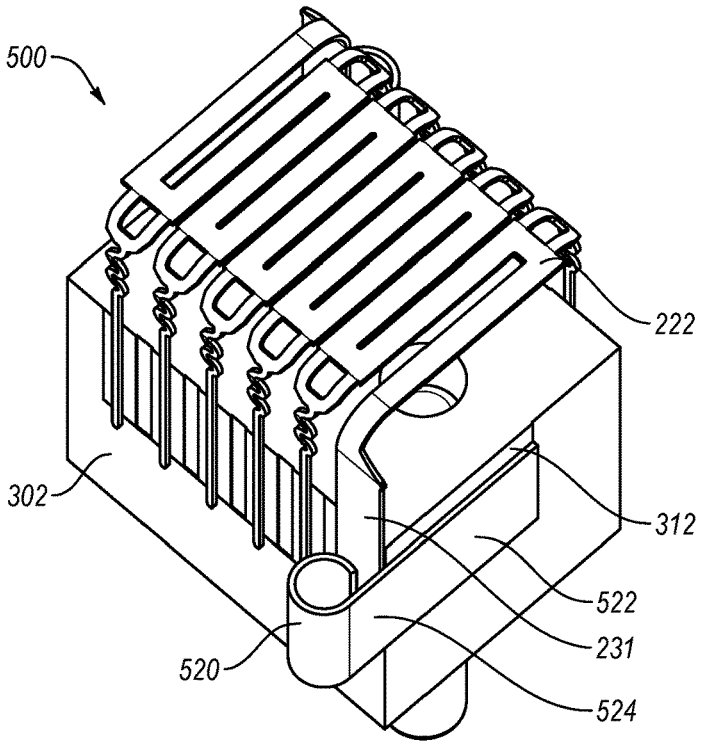
FIG. 5A is a top perspective view of an example of an emitter block that has a ribbon electrical coupler.

FIG. 5A illustrates an embodiment of an emitter block 500 that has a ribbon electrical coupler 524 that forms a connection with the lead leg 231 and contact pad 312. The ribbon electrical coupler 524 can also be coupled to electrical lead 227*a*, 227*b*. The electrical coupler 524 is shown to have a curved portion 520 and a flat portion 522. The curved portion 520 can expand and contract during use and high heat, and non-use and low heat, respectively, so as to maintain the electrical and mechanical couplings. The ribbon electrical coupler 524 can reduce thermal constraints to the serpentine emitter pattern. Other types of ribbon electrical couplers can be used so that there is flex between the lead leg and the electrical leads of the cathode head.

Figure 5B:
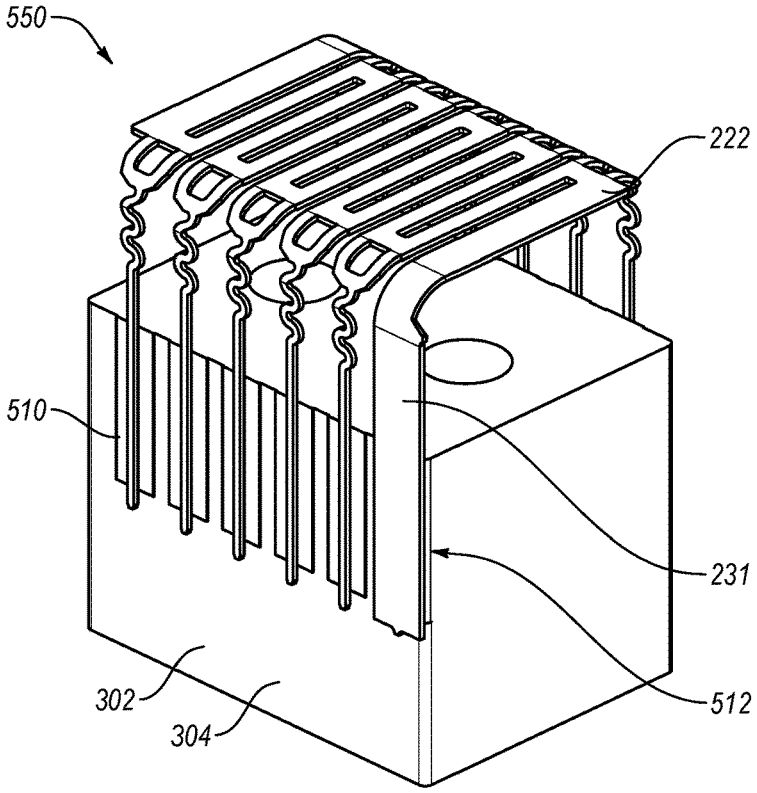
FIG. 5B is a side perspective view of an example of an emitter block.

FIG. 5B illustrates an embodiment of an emitter block 550 that has the lead leg 231 coupled to a contact pad 512 that is on the surface 304 of the insulating block 302. The legs 240 are coupled to bond pads 510. The bond pads 510 and contact pads 512 are electrically and/or thermally isolated from each other and may or not be in recesses, and may be located directly on the surface 304. The lead leg 231 can be coupled to an electrical lead 227*a*, 227*b*, by any way, such as direct or through an electrical and/or mechanical coupling. However, the bond pads 510 and/or contact pads 512 are optional as the planar emitter can be coupled directly to the insulating block 302. The other side of the emitter block 550 can be similarly configured.

The emitter body 229 can have various configurations; however, one configuration includes at least one flat emitter surface that when patterned in a planer emitter pattern 230 forms the planar emitter surface 234. That is, the emitter body 229 is continuous and patterned so that electrical current flows from the first electrical lead 227*a* through the emitter body 229 in the emitter pattern 230 to the second electrical lead 227*b*, or vice versa.

Figure 6A:
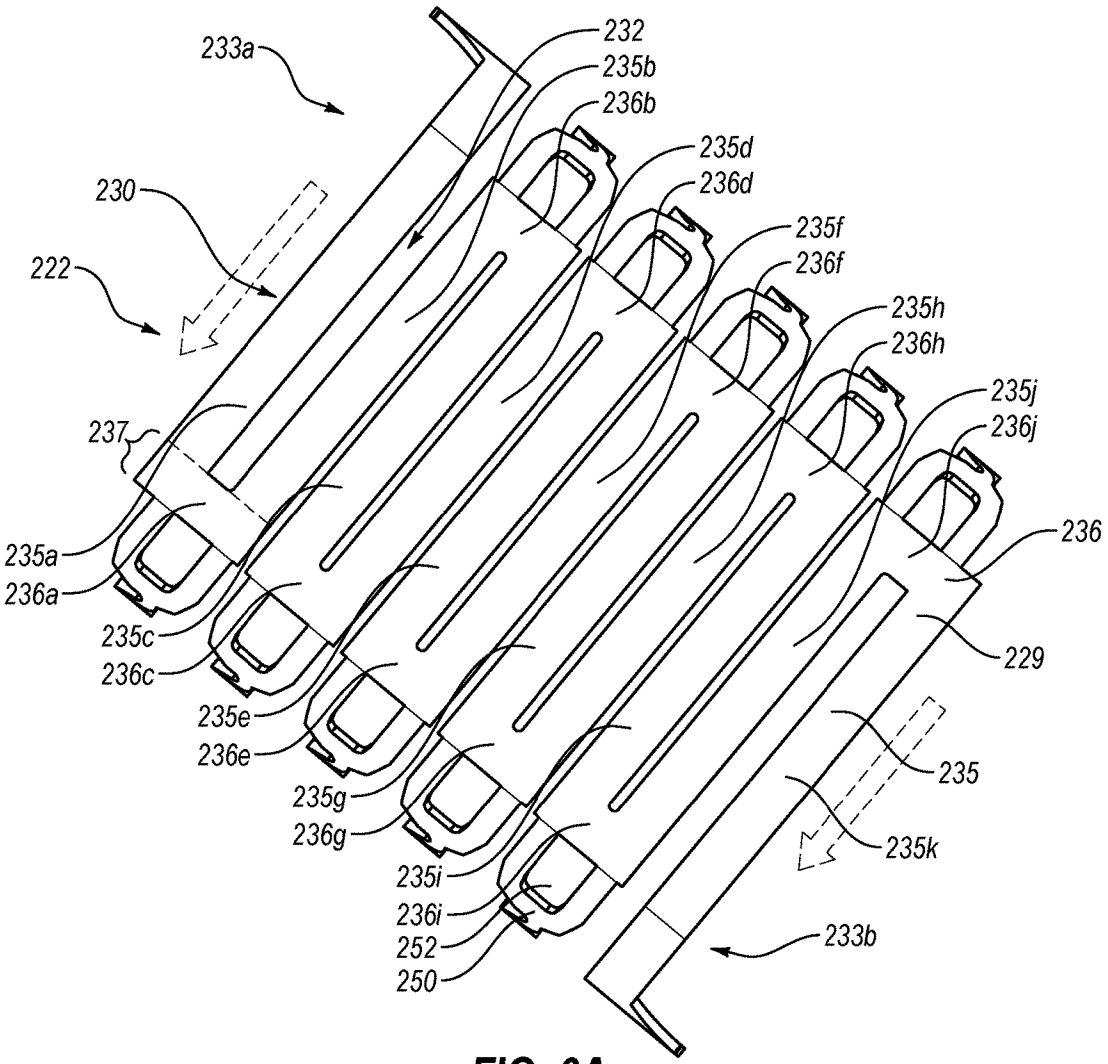
FIG. 6A is a top view of an example of a stabilized emitter.
Figure 6B:
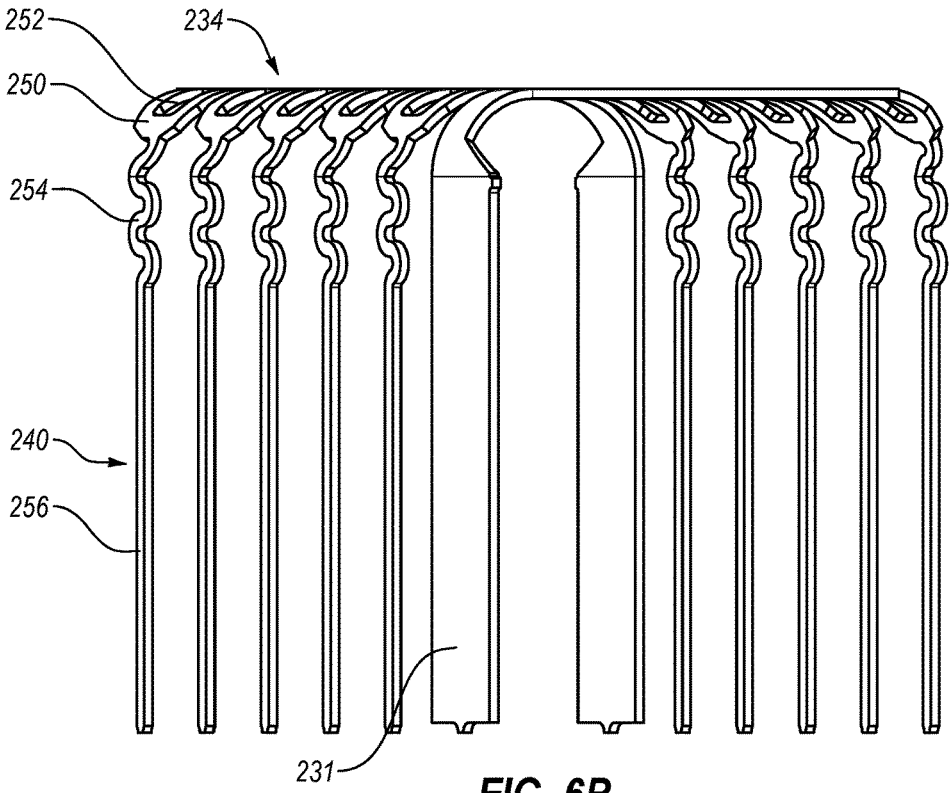
FIGS. 6B-6C show different views of the stabilizer legs of the stabilized emitter of FIG. 6A.
Figure 6C:
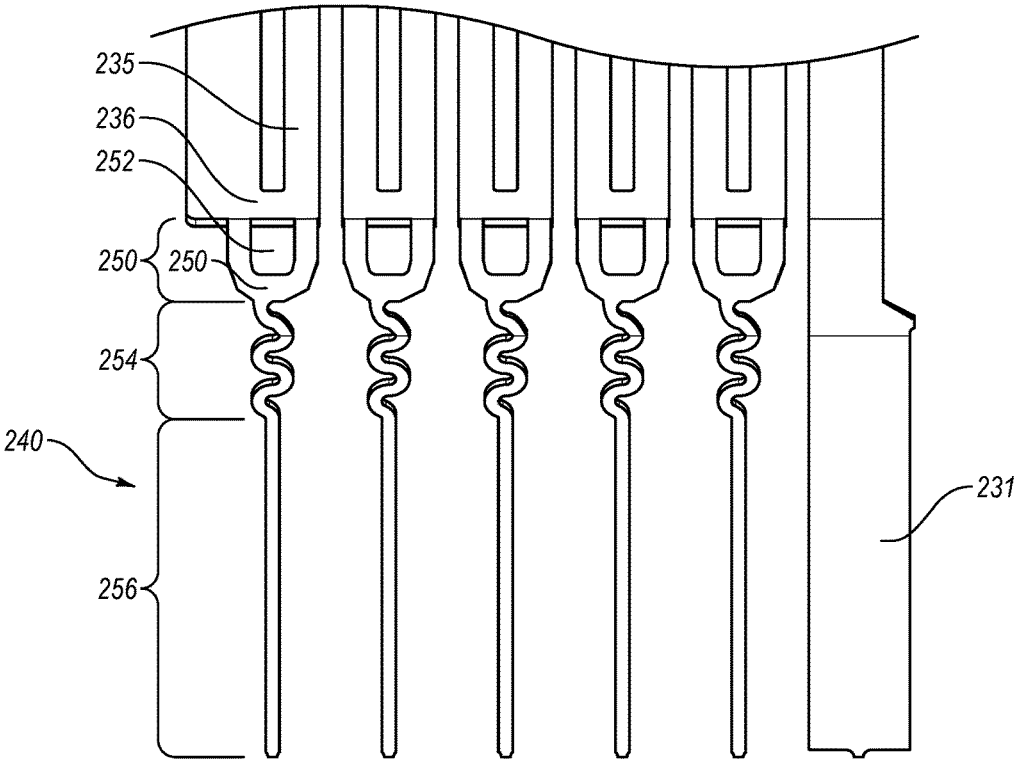

FIGS. 6A-6C illustrate the stabilized emitter 222, where FIGS. 6A-6B illustrate the full stabilized emitter 222, FIG. 6C illustrate a bisected stabilized emitter 222 that shows only one side, and is tipped slightly so that the turns 236 and rungs 235 can be observed.

FIG. 6A shows a top view of the stabilized emitter 222 that allows for a clear view of various features of the electron emitter 222 that are now described in detail. The emitter body 229 includes rungs 235 connected together at turns 236 (e.g., shown as U turns, can be V turns or other turn) so as to form the serpentine emitter pattern 230, where the rungs 235 are the elongate members between the turns 236 and connected end to end (e.g., 235*a*-235*k*) at the turns 236 (e.g., 236*a*-236*j*) from the first end 233*a* to the second end 233*b*. However, any number of rungs 235 can be used as is reasonable and in any orientation or shape. The turns 236 are shown to turn 180 degrees between each rung 235; however, the turns 236 may have sharper turns or looser turns with different degrees that are greater or less than 180 turns. While not shown, each turn 236 can have a slot protruding from the gap 232 between rungs 235 into the turn 236, such as to the flat portion or the corner portions and/or from the flat portion or corner portions. The body of the turns 236 between apex/nadir of the corner and thereby between the rungs 235 is referred to as a base 237. As such, the base 237 of the turns 236 connects the adjacent rungs 235. As shown, the gaps 232 separate all of the rungs 235 from each other and all of the turns 236 from each other. This provides for a single serpentine electrical path shown by the dashed arrows from the first end 233*a* to the second end 233*b*.

The rungs 235 can all be the same cross-sectional dimension (e.g., height and/or width), all be different dimensions, or any combination of same and different dimensions from the first end 233*a* to the second end 233*b*. The rungs 235 may all have the same length. The gaps 232 can all be the same dimension (e.g., gap width dimension between adjacent rungs 235), all be different dimensions, or any combination of same and different dimensions from the first end 233*a* to the middle region 233*c* (FIG. 3A) and from the middle region 233*c* to the second end 233*b*. The turns 236 can all be the same configuration, all be different configurations, or any combination of same and different configurations from the first end 233*a* to the second end 233*b*. The turn bases 237 can all be the same dimension (width or length), all be different dimensions, or any combination of same and different dimensions from the first end 233*a* to the second end 233*b*. Changing the dimension of any of these features, alone or in combination, can change the electron emission profile, which allows for selective combinations to tune the electron emission profile. Additionally, the longitudinal length of each rung may be changed or optimized in order to obtain a desired temperature profile.

In one example, the width of the two end rungs 235*a*, 235*k* can be the same dimension, while the rest of the rungs 235*b*-235*j* can all be another different dimension. In one example, the gaps 232 adjacent to all of the outer rungs 235*a*, 235*k* can be the same dimension, while the rest of the gaps 232 can all be another different dimension. In one example, the corners of each turn 236 can have an apex that is smooth and rounded or sharp and pointed. In one example, the bases 237 at end turns 236*a*, 236*j* can be a different dimension from the bases 237 at inner turns 236*b*-236i.

In one aspect, no portions or regions of the emitter body 229 touch each other from the first end 233*a* to the second end 233*b*. The emitter pattern 230 may be tortuous with one or more bends, straight sections, curved sections, elbows or other features; however, the emitter body 229 does not include any region that touches another region of itself. In one aspect, all of the sections of the rungs 235 or turns 236 between corners or elbows are straight, which can avoid open windows or open apertures of substantial dimension within the emitter pattern 230, where openings of substantial dimensions can cause unwanted side electron emission lateral of the throw path. Thus, the electrical current only has one path from the first lead 227*a* to the second lead 227*b*, which is through the emitter body 229 in the emitter pattern 230 from the first end 233*a* to the second end 233*b*. However, additional leads can be coupled to the emitter body 229 at various locations of the emitter pattern 230 so as to tune the temperature and electron emission profiles.

The planar layout (e.g., planar emitter pattern 230) of the current path of the stabilized emitter 222 is created to produce a tailored heating profile. The tailoring can be performed during the design phase in view of various parameters of one or more end point applications. Here, since the emission of electrons is thermionic, emission can be controlled and matched to the desired emitting region of the electron emitter planar surface 234 by designing the heating profile of the emitting region. Further, tailoring the temperature and emission profiles during design protocols allows the profile of the emitted electron beam to be controlled and can be used to create the desired one or more focal spots. This configuration of a stabilized emitter 222 is in direct contrast to traditional helically wound wire emitters, which do not create electron paths that are perpendicular to the emitter surface, and therefore are not useful in, for example, so-called "long throw" applications. Additionally, the shape and size of a circular flat emitter limits total emission and the shape does not easily facilitate tailoring the spot size and shape to a particular application. On the other hand, embodiments of the proposed stabilized emitter 222 such as shown in the figures can be scalable and the emitter form and pattern can be designed to be tailored to various shapes and can be used in any type of X-ray tube, including but not limited to long throw tubes, short throw tubes, and medium throw tubes, as well as others.

In one embodiment, the stabilized emitter 222 can be comprised of a tungsten foil, although other materials can be used. Alloys of tungsten and other tungsten variants can be used. Also, the emitting surface can be coated with a composition that reduces the emission temperature. For example, the coating can be tungsten, tungsten alloys, thoriated tungsten, doped tungsten (e.g., potassium doped), zirconium carbide mixtures, barium mixtures or other coatings can be used to decrease the emission temperature. Any known emitter material or emitter coating, such as those that reduce emission temperature, can be used for the emitter material or coating. Examples of suitable materials are described in U.S. Pat. No. 7,795,792 entitled "Cathode Structures for X-ray Tubes," which is incorporated herein in its entirety by specific reference.

For example, the end rungs 235*a*, 235*k* can be fabricated so as to be wider than middle rungs and/or inner rungs 235*b*-235*j*, thereby assuring less electrical resistance so as to remain cooler resulting in lower (or no) emission of electrons. Moreover, the widths of the gap 232 between adjacent rungs 235 can be adjusted to compensate for rung width thermal expansion and rung length thermal expansion, as well as for width and length contraction.

In one embodiment, the turn 236 widths can be used to tune the resistance in the rungs 235, and thereby the heating and temperature of each rung 235 due to current passing therethrough can be tuned. For example, in certain applications the midpoints of the rungs 235 can be heated readily, with the ends at the turns 236 tending to be cooler. Adjusting the dimension of the turns 236 provides a level of control to "tune" the thermionic emission characteristics of the stabilized emitter 222. The turns 236 and bases 237 thereof can be dimensioned such that the temperature of the rung 235 matches a desired value and is more uniform between turns 236 along the lengths of each rung 235. This affects the rungs 235 on either side of the turn 236, so a base 237 dimension can be matched to the two rung lengths of the rungs 235 that the particular base 237 is between. This also provides some control over individual rung 235 temperatures so it is possible to create a temperature profile across the width and length of the entire stabilized emitter 222 which can be tailored or tuned to meet various needs or specific applications. Tuning the turn 236 and base 237 dimensions can be accomplished by varying the length of the base 237 that extends between the corners.

Tuning gap dimensions and tuning turn and base dimensions can be considered a primary design tool for tuning temperature and electron emission profiles of the stabilized emitter 222. Often, the base 237 of each turn 236 can be about the same dimension as the width of the rungs 235, or within 1%, 2%, 4%, 5%, or 10% thereof. Often, the gaps 232 can be about the same dimension as the width of the rungs 235, or within 1%, 2%, 4%, 5%, or 10% thereof.

In one embodiment, the width of one or more of the rungs 235 can be adjusted to tune the temperature profile, which in turn tunes the electron emission profile; however, this approach can be considered to be a secondary design tool in terms of achieving specific temperature and electron emission profiles. In certain applications, modification of the width of the rungs 235 may not have as strong of an effect on the temperature profile, and might tend to heat or cool the entire length of the rung 235. However, this approach can be used to suppress the emission on the end rungs 235*a*, 235*k* of the stabilized emitter 222. Dimensioning the end rungs 235*a*, 235*k* tend to be larger or have a larger dimension can avoid emission from the end rungs 235*a*, 235*k* where emission can create undesirable X-rays that manifest as wings and/or double peaking in the focal spot. On the other hand, dimensioning the middle rungs or inner rungs as well as the central rung to be relatively smaller in dimension can enhance emission from these rungs 235. As such, dimensioning one or more rungs 235 to be smaller than one or more other rungs 235 can result in the smaller rungs having enhanced electron emission compared to the larger rungs. Thus, any one or more rungs 235, connected or separated, can be dimensioned to be smaller to increase electron emission or dimensioned to be larger to inhibit electron emission.

While the dimensions of the rungs 235, gaps 232, and/or turns 236 are usually considered in the planar dimension that is shown in FIG. 6A, the orthogonal dimension (e.g., height that is into or out from the page of FIG. 6A) may also be tuned. Also, the dimension of the rungs 235, gaps 232, and/or turns 236 being tuned can be width or height so that the cross-sectional area is tuned. On the other hand, the height can be set where the width is tuned so that the planar emitter surface 234 is tuned for electron emission.

In one embodiment, relative cooling of rungs 235 in other positions can be done by making these rungs 235 relatively larger as needed to modify the emission profile and/or to create other focal spots or multiple focal spots. For example, relative cooling (e.g., comparatively reduced temperature) of the central rung 235*f* or inner-most rungs (e.g., 235*e*, 235*f*, 235*g*) of the stabilized emitter 222 can be done by making these rungs have a larger dimension (e.g., wider) compared to the outer rungs (e.g., 235*b*-235*d*, 235*h*-235*j*) to create a hollow beam for certain applications. The outer rungs (e.g., 235*b*-235*d*, 235*h*-235*j*) can be larger than the middle rungs (e.g., 235*e*, 235*f*, 235*g*) so that the electron emission can be condensed into the center of the electron emitter 222. Thus, the dimensions of different rugs 235 can be tailed alone, or with the dimension of the gaps 232 and turns 236, for tuning temperature and electro emission profiles.

In another embodiment, a variable width down the length of one or more rungs 235 can provide a tuned temperature and emission profile. However, such rung 235 dimensioning should be tailored in view of adjacent rungs 235 across the gaps 232 to avoid larger gaps 232 between rungs 235, which larger gaps 232 can in turn create more edge emission electrons with non-parallel paths, which is unfavorable.

In one embodiment, it can be desirable to dimension the gaps 232 in accordance with the thermal expansion coefficient of the emitter body material so that a gap 232 always exists between adjacent rungs 235 while cool and while fully heated. This maintains the single electrical current path from the first end 233*a* to the second end 233*b*.

In view of design optimization of the emitter pattern 230 and dimensions thereof, the following dimensions can be considered to be example dimensions that can be designed by the design protocols described herein. The height (e.g., material thickness) of each rung 235 can be about 0.1 mm, or about 0.1 mm to 0.15 mm, or about 0.05 mm to 0.254 mm. The rung 235 width can be about 0.5 mm, or about 0.5 mm to 0.64 mm, or about 0.25 mm to 0.89 mm. The rung 235 width can be determined along with the rung length and rung thickness so that each rung is designed to match the emitter supply's available current. The rung 235 length can be about 4 mm to 5 mm, or about 3 mm to 7 mm, or about 2.75 mm to 10 mm, where the rung 235 length can be dimensioned depending on the emission area and the resulting emission footprint. The gap 232 width can be about 0.254 mm, or about 0.24 mm to 0.26 mm, or about 0.22 mm to 0.28 mm, or about 0.2 mm to 0.3 mm, or 0.1 mm to 0.15 mm, or about 0.1 mm to 0.2 mm, or about 0.5 mm to 0.4 mm where the gap 232 width can depend on thermal expansion compensation needed to maintain the gaps so that the adjacent rungs 235 do not touch. The result of the dimensioned stabilized emitter 222 is that for a given heating current, desired emission current (mA), focal spot size, and allowed foot print, the dimensions of the rung 235, turn 236, and gap 232 can be modified to design a stabilized emitter 222 that creates a laminar electron beam needed for a particular application. It should be recognized that the dimensions and relative dimensions provided herein are examples, and the individual and relative dimensions can vary.

In yet other embodiments, other general shapes and/or other cut patterns can be designed to achieve a desired emission profile for an electron emitter. Various other configurations, shapes, and patterns can be determined in accordance with the electron emitter embodiments described herein.

FIGS. 6B-6C show different views of the stabilized emitter 222 that allows for a clear view of the legs 240 that are now described in detail. As shown, each turn 236 has a linker 250 that links each turn 236 to each leg 240. That is, the base 237 of each turn 236 is connected to a linker 250. As such, each turn 236 is shown to have a corresponding leg 240 linked thereto through a linker 250. The linker 250 is shown to connect to the corners of the turn 236, which provides mechanical stability to the corners and turns 236 so that the corners and turns 236 do not curl or warp after repeated use. The linker 250 is connected to the corners to keep the corners from buckling from heat cycles. The linker 250 is shown to have a curved "U" shape that has each end attached to a corner of the turn 236, which form an aperture 252 with the base 237. The linker 250 may, however, be devoid of an aperture and can have a body that extends from the turn 236 to the leg 240. The shape and configuration of the linker 250 may vary; however, it can be beneficial for the linker 250 to be attached to both corners of a turn 236 to inhibit curling or other deformation that may occur over time and repeated temperature cycles. Also, the linker 250 may be omitted and the turn can be coupled directly to the leg 240.

Each leg is shown to have a tortuous region 254 that extends from the linker 250 to a straight region 256. However, the tortuous region 254 may be omitted. Also, the tortuous region 254 can me modified from the illustration, such as having sharp zigzags that are "V" or "W" shaped, as repeating units. The number of curves in the tortuous region 254 can be varied as well as the tightness or looseness of each curve. The curves in the tortuous region 254 can provide a spring-like function or length adjustment function so that the tortuous region 254 can absorb heat expansion of rungs 235 and allow for cooling contraction of rungs 235 without causing curvature of the corners of a turn 236 or curving of the flat planar surface 234.

Each leg also has a straight region 256 that is shown to extend from the tortuous region 254. However, the straight region 256 may be attached directly to the linker 250 or even to the turn 236. The length of the straight region 256 can vary as needed or desired. Also, the straight region 256 may be omitted and the entire leg 240 may be a tortuous region 254, or the tortuous region 254 may be omitted and the entire leg 240 may be a straight region 256.

The legs 240 are connected from the planar surface 234 to the insulating block 302 and are not electrically coupled but for the rungs 235 and turns 236 of the planar surface 234. As such, the legs 240 are electrically isolated from each other so that electrical current does not flow directly from one leg 240 to another leg 240. The legs 240 may or may not be coupled to additional electrical leads, when attached to different leads different current flow paths can be generated to tune the electron emission profile. When the legs 240 are only coupled to the insulating block 302 and not additional electrical leads, the legs 240 are not part of the main electrical path. When coupled to other electrical leads, the legs 240 can define new electron paths to cause some regions to have current and others to have no current, which can result in inhomogeneous temperature and emission profiles. The locations of the legs 240 can then provide for custom electron paths and thereby custom emission patterns. While not shown, additional legs 240, e.g., conductive or non-conductive, could be provided for support for the stabilized emitter 222 if needed for a given application. The legs 240 can be attached at the ends, edges, center, or other locations of the rungs 235 or turns 236 along the stabilized emitter 222 or at any other locations. When attached to the non-conductive insulating block 302, the legs 240 can be attached to any region and provide support to keep the stabilized emitter 222 to have the planar emitter surface 234. When attached to a conductive member or electrical lead, the legs 340 can be attached to any region to provide support to keep the stabilized emitter 222 to have the planar emitter surface 234 and to define electron flow paths to customize the temperature and emission profiles. The legs 240 are integrated with the planar surface 234, and thereby the legs 240 and planar emitter surface 234 are part of the emitter body 229. Here, the linkers 250 are considered to be part of the legs 240, but the linkers 250 may be omitted or considered to be separate from the planar emitter surface 234 and legs 240. The stabilized emitter 222 may be an integrated member formed into a single continuous member that includes the planar surface 234 and legs (e.g., linkers 250, tortuous region 254, and straight region 256), or each component can be a separate member that is coupled to the other members.

Figure 6D:
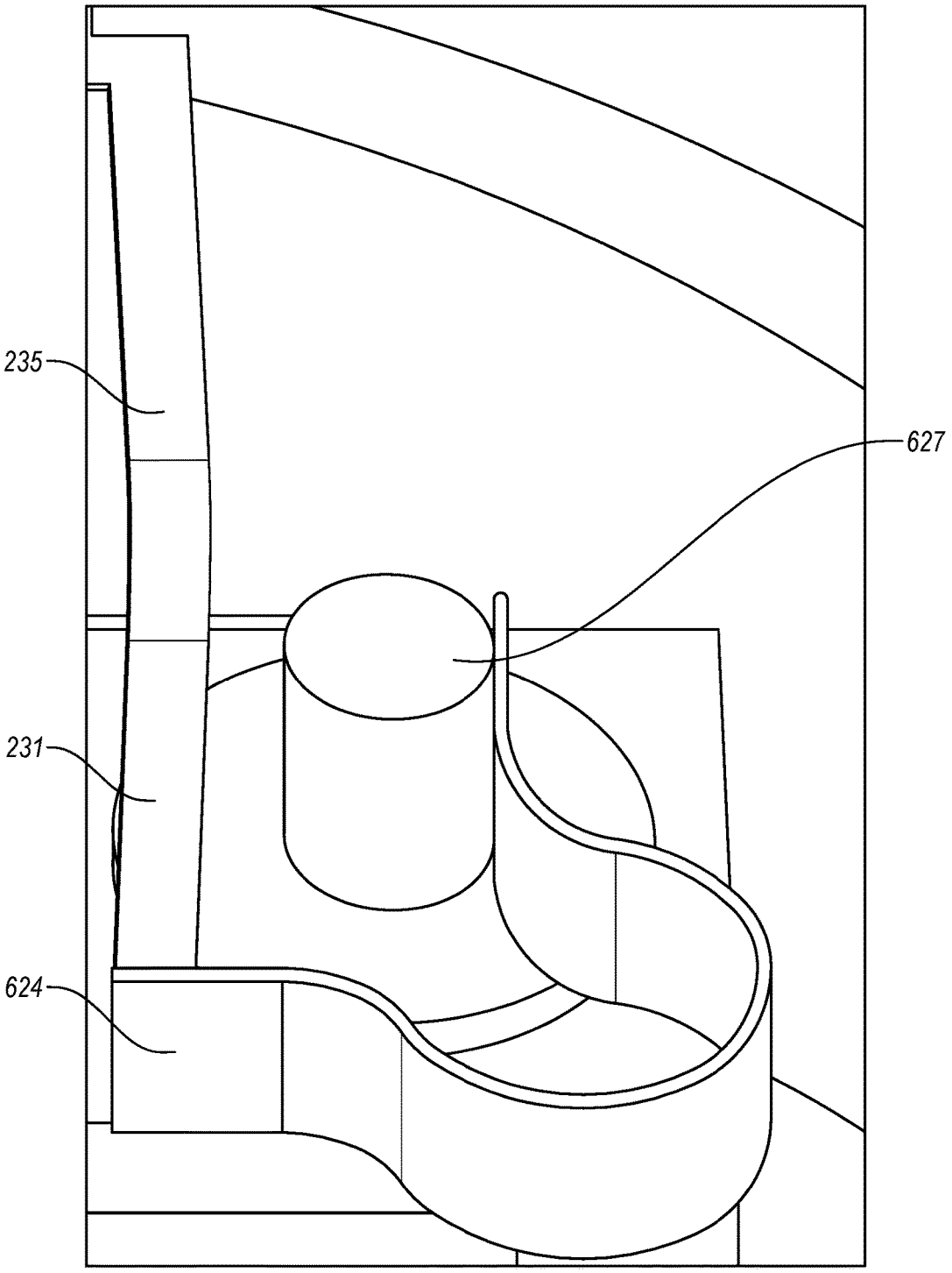
FIG. 6D is a perspective view of an example of a flexible ribbon electrical connector that attaches the lead leg to the electrical lead.

FIG. 6D shows a ribbon electrical connector 624 that attaches the lead leg 231 to the electrical lead 627. This ribbon electrical connector 624 can provide a robust electrical connection from the stabilized emitter 222 to the electrical lead 627. The ribbon electrical connector 624 may be flexible to allow for thermal expansion and contraction without compromising any electrical connection.

Figure 7:
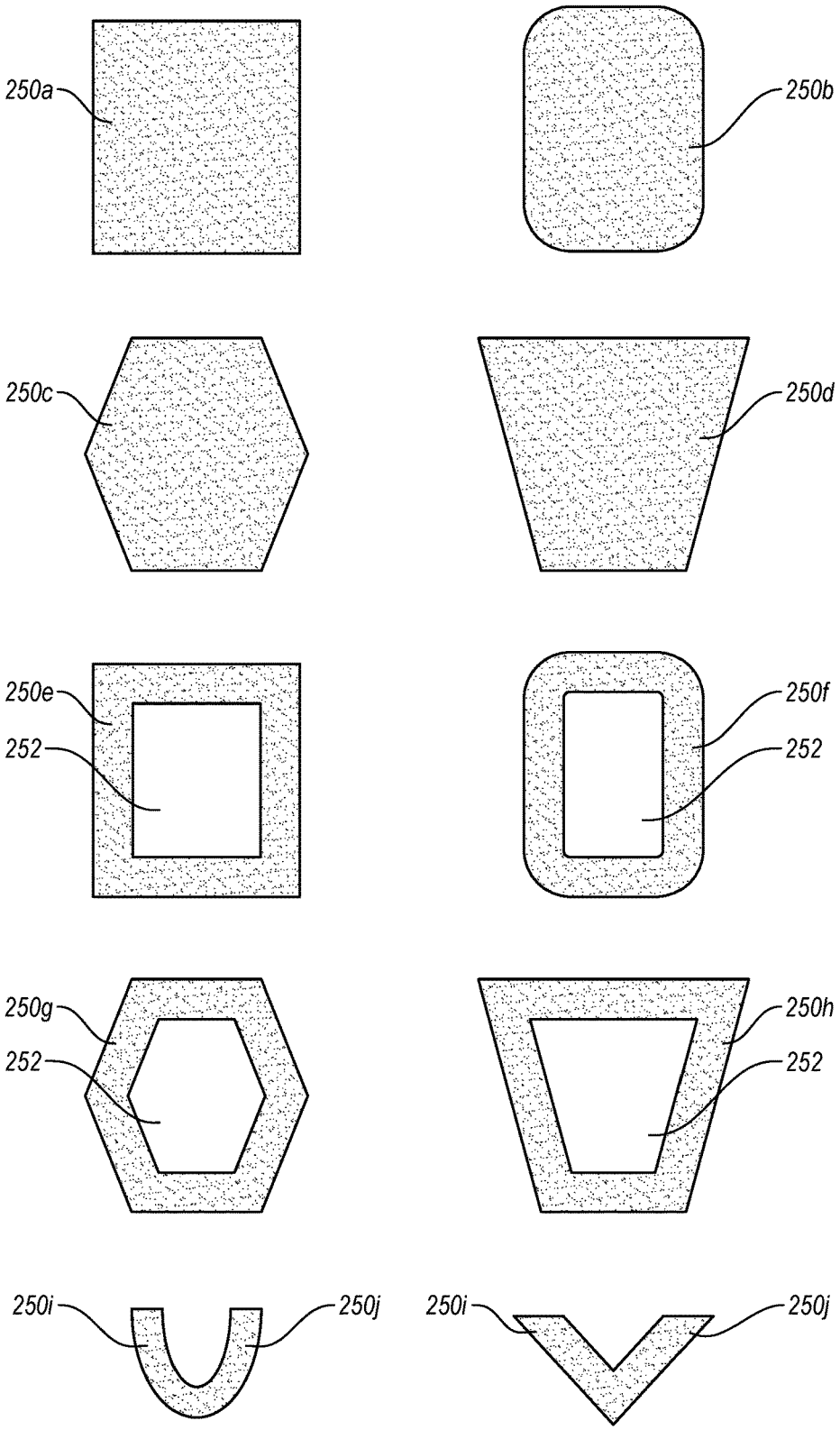
FIG. 7 illustrates various exemplary embodiments of the linker portion of the stabilizer legs.

FIG. 7 illustrates various exemplary embodiments of the linkers 250, which shows linkers 250 with and without the apertures 252. As shown, the shapes can vary, such as square 250*a*, rounded square 250*b*, octagon 250*c*, trapezoid 250*d*, hollow square 250*e*, hollow rounded square 250*f*, hollow octagon 250*g*, hollow trapezoid 250*h*, or any other, or any combination thereof. Also, the linkers 250 can be two separate members, such as linkers 250*i*, 250*j* that attach to opposite corners of the turn 236 and then both couple to the same leg 240, which forms an aperture 252 with the turn 236. Stated another way, a single linker can have portions 250*i* and 250*j* (e.g., straight or curved) that extend from a leg 240 to a turn 236. Also, the tops of the linkers 250*a*-250*j* can be bonded or integrally formed with the turn 236. The tops of linkers 250*e*-250*h* may be omitted so that only the side arms connect the legs 240 to the turns 236 so that the linker 250 is similar to the bottom two linkers that have linkers 250*i*, 250*j*.

Figure 8A:
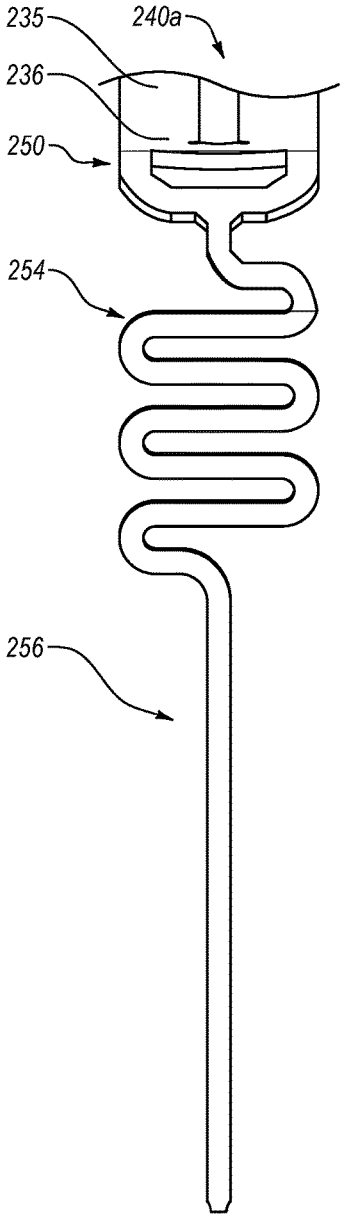
FIGS. 8A-8C are side views that illustrate different embodiments of stabilizer legs.
Figure 8B:
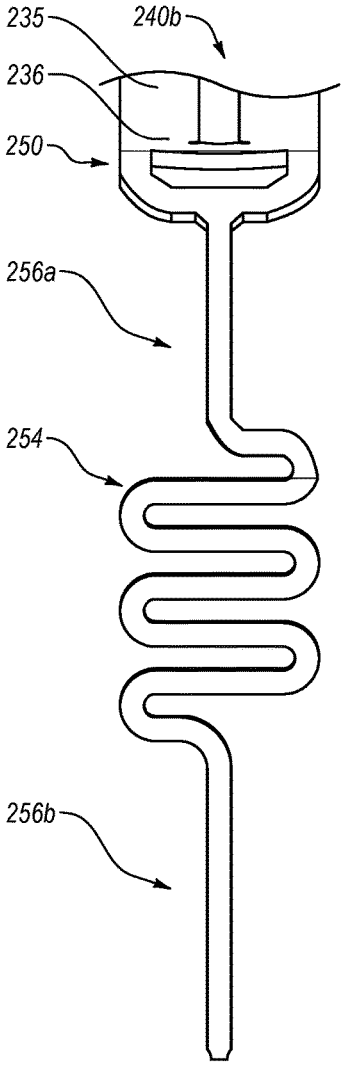
Figure 8C:
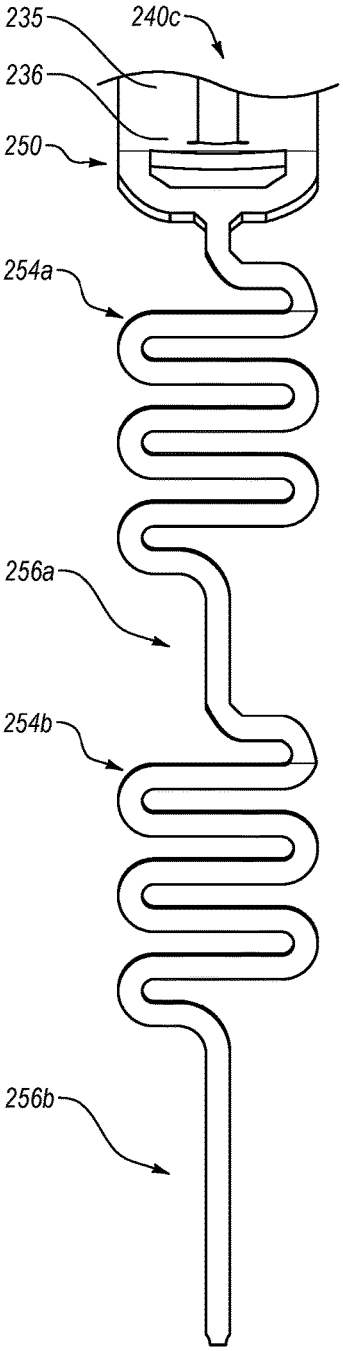

FIGS. 8A-8C illustrate different embodiments of legs 240*a*, 240*b*, 240*c*. The leg 240*a* is shown to have the turn 236 connected to the linker 250, and the linker 250 is connected to the tortuous region 254, and the tortuous region 254 is connected to the straight region 256. The leg 240*b* is shown to have the turn 236 connected to the linker 250, the linker 250 attached to a first straight region 256*a*, the first straight region 256*a* connected to a tortuous region 254, and the tortuous region 254 connected to a second straight region 256*b*. The leg 240*c* is shown to have the turn 236 connected to the linker 250, the linker 250 attached to a first tortuous region 254*a*, the first tortuous region 254*a* connected to a first straight region 256*a*, the first straight region 256*a* is connected to a second tortuous region 254*b*, and the second tortuous region 254*b* is connected to a second straight region 256*b*. As such, embodiments can include any number of tortuous regions 254 and/or any number of straight regions 256, which can be arranged in any sequence. Here, the tortuous regions 254 have longer rungs between turns compared to those of other figures. As such, the configuration of the tortuous region 254 can be altered with tighter or looser turns, more or less turns, more angled turns or less angled turns, or longer or shorter rungs between the turns. Also, the leg can be devoid of the tortuous region or have any number of tortuous regions or any number of turns in the tortuous region. In one aspect, the entire leg may be the tortuous region such that the leg is devoid of the straight region, or any number of straight regions can be used that are separated by tortuous regions having any number of turns.

Figure 9:
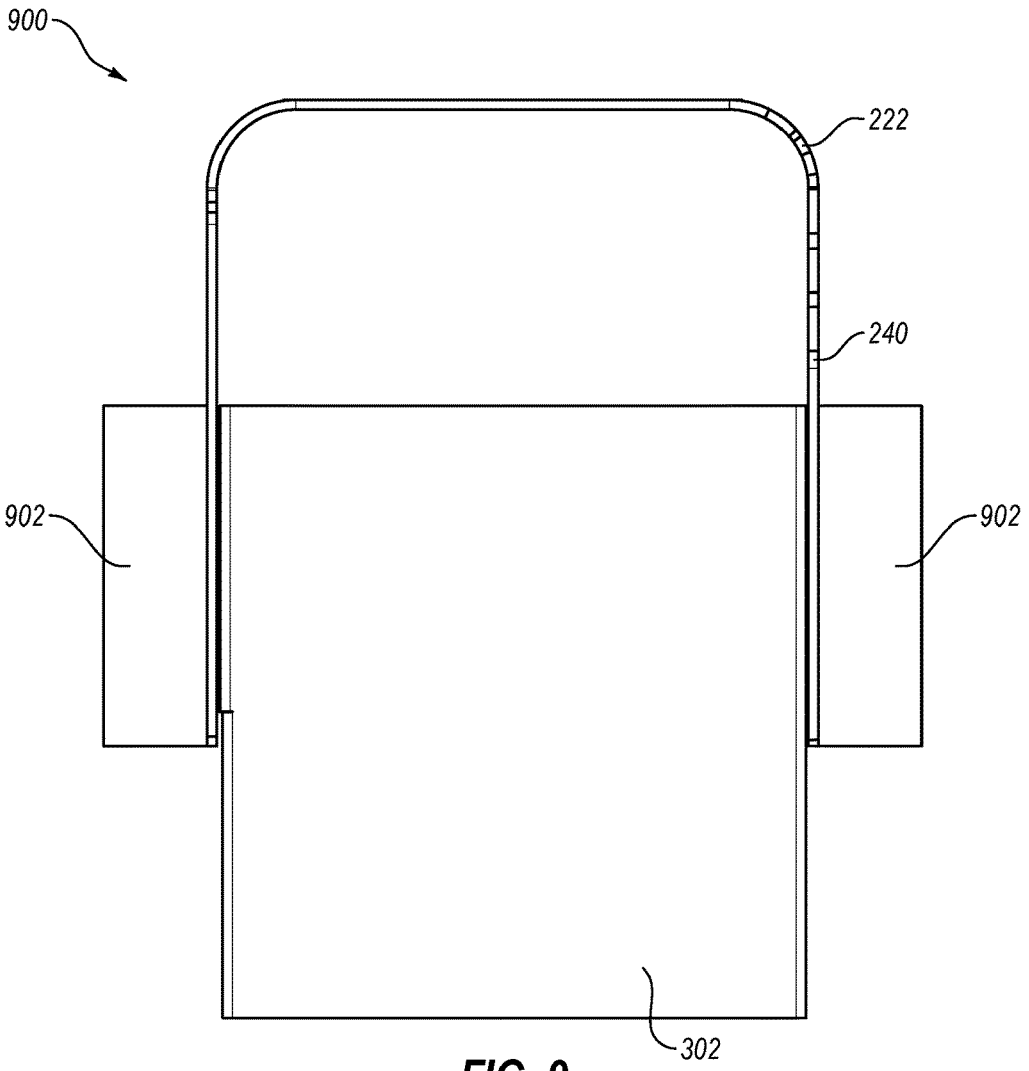
FIG. 9 is a cross-sectional side view that shows an alternative means for attaching the stabilizer legs to the insulating block.

FIG. 9 shows an emitter block 900 that has an alternative means for attaching the legs 240 to the insulating block 302. Instead of using a weld or braze or adhesive, a pressure coupling can be used. Here, a pressure block 902 is shown to pressure couple each leg 240 to the insulating block 302. The pressure block 902 and insulating block 302 have the leg 240 therebetween. The pressure block 902 is then attached to the insulating block 302 by any means, such as screws or bolts. The pressure applied to the legs 240 by the pressure block 902 against the insulating block 302 can hold the legs 240 in place.

Figure 10:
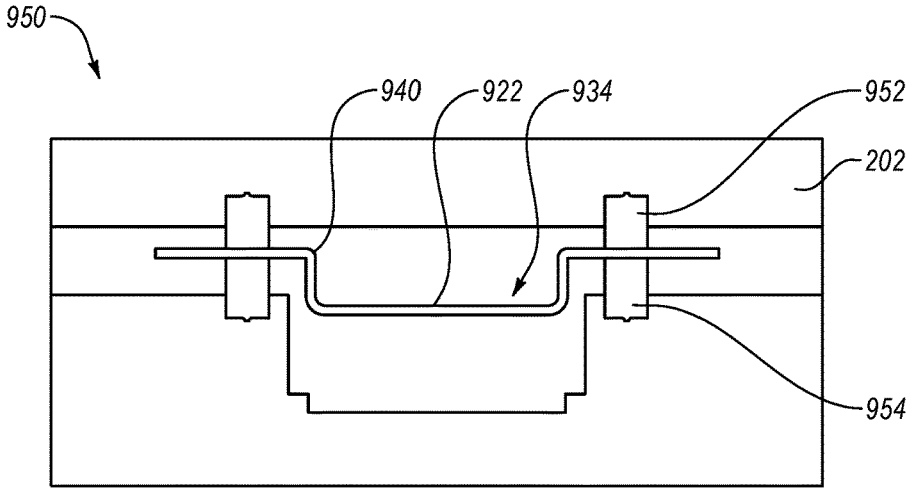
FIG. 10 is a cross-sectional side view that shows an alternative embodiment of a stabilized emitter with bent stabilizer legs.

FIG. 10 shows an alternative embodiment of an emitter block 950 that has the stabilized emitter 922 with bent legs 940. The stabilized emitter 922 can have the same shape and functions as described herein, such as stabilized emitter 222. As shown, each of the legs 940 include bends that allow for the legs 940 to be substantially planar with the planar emitter surface 934. The legs 940 are coupled to insulating blocks 952, 954, which can be by pressure coupling, welding, brazing, or the like. The insulating blocks 952, 954 can suspend the legs 940 therebetween so that the stabilizing emitter 922 is electronically isolated except for to the appropriate electrical leads. Also, the stabilized emitter 922 may be used without any bends in the legs. Accordingly, the electron emitters described herein can be used in various platforms. Additional information regarding retaining the stabilized emitter 222 in the position shown for emitter 922 can be found in U.S. Pat. Nos. 8,077,829 and 7,924,983, which are both incorporated herein by specific reference in their entirety.

Figure 11A:
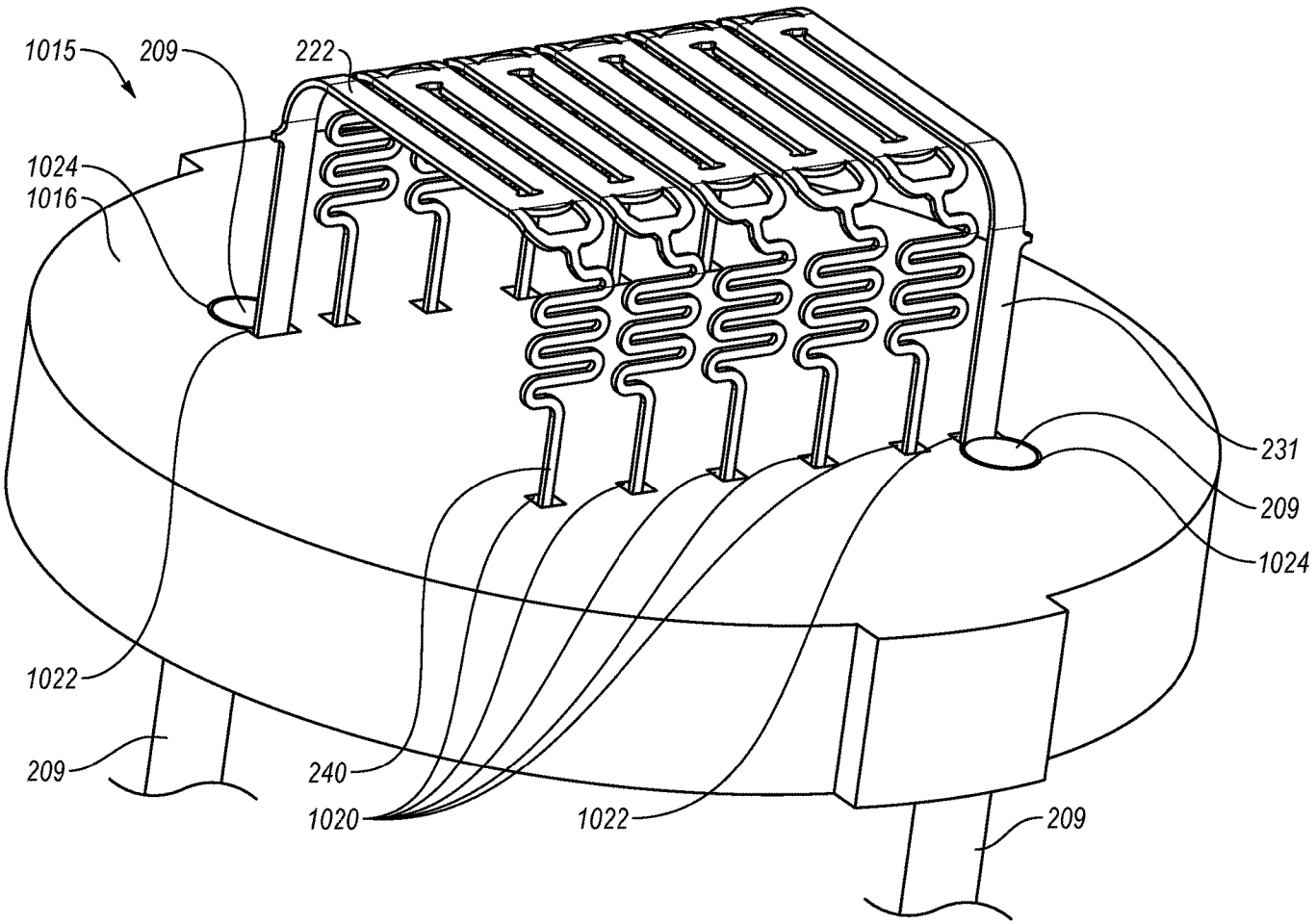
FIG. 11A is a perspective view of a base of a cathode head that has receptacles that receive the legs of the stabilized emitter, receptacles that receive the lead legs of the stabilized emitter, and conduits that receive the electrical leads so that the electrical leads are electrically coupled with the lead legs.
Figure 11B:
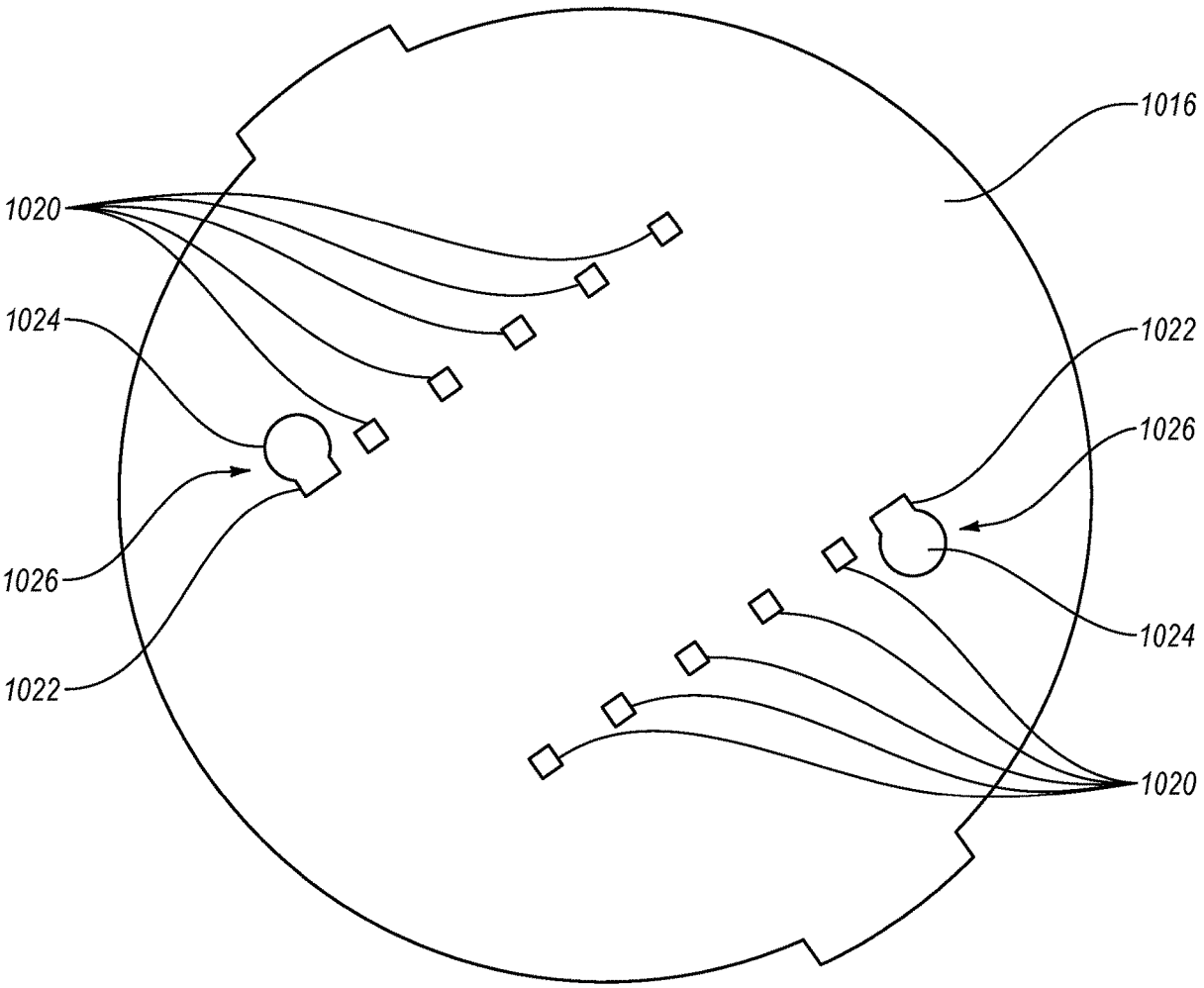
FIG. 11B is a top view of the base of the cathode head to show the receptacles and conduits of FIG. 11A.

FIG. 11A shows another embodiment of a portion of a cathode head 1015 that includes a stabilized emitter 222. As shown, the cathode head 1015 has a base 1016 that is attached to the stabilized emitter 222. The base 1016 has a plurality of receptacles 1020 that arranged in accordance with the configuration of the legs 240 of the stabilized emitter 222, which allows for the legs 240 to be inserted into the receptacles 1020 for stabilization. The receptacles 1020 can be through-holes, apertures, conduits, or other passage that extends into and optionally all the way through the base 1016. Alternatively, the receptacles 1020 can be recesses that do not go all through the base 1016, and have a bottom (not shown) that can receive the end of the legs 240. The base 1016 may also include receptacles 1022 that are adapted to receive the lead legs 231. As such, the receptacles 1020 for the legs 240 may be dimensioned according to the dimensions of the legs 240 (e.g., smaller), and the receptacles 1022 may be dimensioned for the lead legs 231 (e.g., larger). The receptacles 1022 may go all the way through the base 1016 or be a recess with the bottom. The legs 240 can be brazed, welded, adhered, friction-coupled, or otherwise fastened in the receptacles 1020, where similar attachment may be used for the lead legs 231 with the receptacles 1022. The base 1016 may also have lead conduits 1024 that are dimensioned to receive the electrical leads 209 therethrough. The location of the lead conduits 1024 may be adjacent to the receptacles 1022 such that the lead legs 231 can be within the receptacle 1022 and electrically coupled with an electrical lead 209 in the lead conduits. In one example, the receptacles 1022 may be separate receptacles from the lead conduits 1024. In one example, the receptacles 1022 and lead conduits 1024 can be combined as a single conduit 1026 having the shape to receive the lead legs 231 and electrical leads 209 so that the lead legs 231 and electrical leads 209 can be in contact and electrically coupled.

In one embodiment, the stabilized emitter described herein can be utilized in an X-ray tube to emit an electron beam from the cathode to the anode. The configuration of the stabilized emitter can result in an inhomogeneous temperature profile from the first end to the second end and across the entirety of the planar emitter surface when a current is passed through. The inhomogeneous temperature profile can be a result of the planar emitter pattern with the rungs, turns, legs, and gap dimensions. Additionally, the description of the stabilized emitter provided herein describes the ability to tune the stabilized emitter to obtain different temperature profiles. The inhomogeneous temperature profile of the stabilized emitter for a current, results in different regions of the stabilized emitter having different temperatures, which results in the stabilized emitter emitting an inhomogeneous electron beam profile. The inhomogeneous electron beam profile is a result of the inhomogeneous temperature profile, where regions of different temperature have different electron emissions. The ability to tailor the temperature profile allows for tailoring the inhomogeneous electron beam profile, such as by selectively dimensioning the different features so that some regions become hotter than others when in operation. Since the emission is thermionic, different regions of different temperatures result in different election emissions, and thereby result in the inhomogeneous electron beam. This principle also allows for one, two, or more focal spots by having a number of regions with a high emission temperature and other regions with a low emission temperature or the other regions may not emit electrons by thermionic emission. In certain regions, there can be no electrons emitted or relatively few electrons emitted compared to other regions. Thus, during operation of a single electron emitter, certain regions can have enhanced electron emission and others can have suppressed electron emission to contribute to the inhomogeneous electron beam profile.

The stabilized emitter can inhomogeneously emit electrons in an electron beam from the substantially planar surface of the emitter with a reduced lateral energy component.

The legs of the stabilized emitter can be coupled with insulating block by any feasible means. Such coupling can be via a weld or a braze. The braze can be from the metal of the legs to the ceramic of the insulating members. The braze can be to a patterned ceramic with a prebraze consisting of a molybdenum/manganese material ("moly/mag") material. The leg and/or the ceramic can have the moly/mag material, such as a coating or partial coating. The moly/mag can be applied to the ceramic of the insulating block, and then a copper braze material used to braze to the legs. A platinum or nickel braze can also be used. The type of braze can be selected based on the operating temperature of the emitter. Many different brazes can be envisioned, as determined by those skilled in the art.

Moly/mag is a mixture that is fired onto ceramics to which brazes will adhere to. Most brazes do not wet to ceramics unless they are specially formulated and designated as "ABA", such as "Copper ABA" or "Palco ABA." The ABA brazes often contain about 7% Titanium. As such, moly/mag can be used as a prebraze for a subsequent braze to be adhered to. Otherwise, an ABA braze can be used on the ceramic.

The features described herein can maintain a flat emitting surface over the lifetime of an X-ray tube by inhibiting the flat emitting surface from curling or warping. The legs can retain the shape of the flat emitting surface by restricting edge curling. The restricted edges can be held down with the linkers of the legs. As such, the location and arrangement of the legs can inhibit deformation of the flat emitting surface by inhibiting the rungs or turns of the serpentine emitter pattern from curling due to heating and thermal cycling. The emitters described herein have an increased or maximized thermal path, and thereby a reduced or minimized power drain from the flat emitting surface to the legs, which can reduce the temperature dependence of the flat emitting surface on the physical constraint. This can be accomplished by adding a high thermal resistive path, which also functions as a physical restraint. It is noted that thermal resistance is proportional to length and inversely proportional to cross-sectional area.

In one example, the width of the rungs can be 0.508 mm (0.020 inches; 20 mil) with a 0.102 mm (0.004 inches; 4 mil) gap between the rungs. The linker can be shaped to have a member connected to each corner of each turn, which can hold the ends of the serpentine emitter pattern from curling. The linker is attached to a tortuous region of the leg, which can be about 0.154 mm (~0.006 inches) wide, which can increase the length of the leg (e.g., constraining path) to increase the thermal path as the thermal resistance is proportional to the length of the leg. The tortuous region of the leg can be attached to a straight region, which can be about 0.15 mm (~0.006 inch) wide. The straight region facilitates attachment to insulating members. The pitch of the serpentine emitter pattern (e.g., serpentine path) can be about 0.0481 inches (1.22 mm). The legs can provide increased thermal resistance, such as up to 12 times the thermal resistance. The length of the tortuous region can be modulated to modulate the thermal resistance, with longer lengths having more thermal resistance.

The thermal resistance can be increased by the legs by minimizing the cross-sectional area of the legs and/or linker members and/or increasing the length of the leg to the point of connection to the insulating member. The leg length can include the length of the linker, tortuous region, and straight region.

The electron emitter can provide a number of advantages, such as: mechanical stability in rotating gantrys, and mechanical stability to W, ThW emitters as well as with W/Ru/ThO2 coatings. The electron emitter can also have reduced power for heating because there is less thermal drain from the legs attached to the insulating members.

The electron emitter can have a number of design modifications, such as: more or less number of legs; different numbers of legs on each side; different leg widths; legs optimized for strength and lower heat transfer; longer legs for a higher thermal path; or shorter legs for a lower thermal path; or lengthening and widening the legs; or shortening and thickening of the legs.

In one embodiment, an electron emitter can include an emitter body having a planar emitter surface formed by a plurality of elongate rungs connected together through a plurality of turns from a first emitter end to a second emitter end with each turn connecting adjacent ends of two corresponding rungs so as to form a serpentine emitter pattern. The emitter can also include a plurality of elongate legs extending from the plurality of turns. The emitter can be configured as described herein. The rungs can be separated by gaps that inhibit the rungs from contacting each other whether hot or cold. The turns are at the ends of two adjacent rungs and connect the rungs together. The turns can include a base that extends between the ends of the two adjacent rungs. The legs can be at any angle relative to the planar emitter surface, such as 0 degrees or in a common plane to less than 180 degrees, where 90 degrees is an example of the angle. The legs can include a bend that forms the angle.

In one embodiment, the electron emitter can include a leg for each turn. However, other embodiments can have turns without legs or turns with two or more legs. For example, each rung can extend through the turn to a unique leg, where each "corner" of the turn has a separate leg. While the figures show one leg for each turn, the figures can be adapted so that each rung has a leg, where the portions of the linker remain separate and extend into separate legs rather than form the aperture between the linker and turn.

In one embodiment, each leg can have a cross-sectional dimension smaller than a cross-sectional dimension of each of the two elongate rungs from which the leg extends. That is, each leg has a smaller cross-sectional dimension compared to each rung. The rungs and legs may have the same or different thickness. As such, the rungs can have a wider width compared to the legs.

In one embodiment, each leg includes a linker that is connected to a corresponding turn. Each linker can have a linker body with a cross-sectional dimension that is smaller than a cross-sectional dimension of each of the two elongate rungs from which the leg extends. The cross-sectional dimension is of the body of the linker member without including any aperture formed by the linker with or without the turn. The linker inhibits the turn from curling or warping, and keeps the turn planar with the rungs, and thereby inhibits the rungs from curling or warping.

In one embodiment, each linker extends from at least one corner region of the corresponding turn, where each corner region is formed from an intersection of an elongate rung and a base of a turn. That is, each corner of the serpentine emitter pattern can be structurally reinforced by the linker and leg. This allows the corner to be kept planar with the planar emitter surface and inhibits curling or warping of the corners.

In one embodiment, the linker has a first portion coupled to the turn and a second portion coupled to the turn, which can be at the same location on the turn or different locations on the turn. This configuration of the linker forms an aperture with the corresponding turn. However, the linker can have the aperture in the linker itself, as illustrated.

In one embodiment, each leg includes at least one tortuous region and at least one straight region. However, a leg may be entirely a tortuous region. On the other hand, a leg may be entirely a straight region. The tortuous region or straight region can be used for coupling with the insulator block. The leg can include any number of tortuous regions or any number of straight regions, in any order or orientation. However, each leg is elongate and extends from the turns.

In one embodiment, each leg includes a linker connected to a corresponding turn, and each leg includes a tortuous region and a straight region. In one aspect, each leg includes a linker connected to a corresponding turn, and each leg includes a tortuous region connected to and extending from the linker and a straight region connected to and extending from the tortuous region. In one aspect, each leg includes a linker connected to a corresponding turn so as to form an aperture between the linker and turn, and each leg includes at least one tortuous region and at least one straight region, wherein at least one tortuous region is between a straight region and the linker.

In one embodiment, each rung is parallel with each other rung, and each rung is separated from each other adjacent rung by a gap. As such, each gap is parallel with the other gaps. The base of each turn can be parallel with the bases of the turns on the opposite side of the emitter and aligned with the bases of turns on the same side of the emitter. The legs may also be parallel with each other, such as with legs on the same side of the emitter and opposite side of the emitter. The legs on one side of the emitter can be staggered with respect to the legs on the other side of the emitter, which results from the turns being staggered and not directly across from each other. The shaping results from the serpentine pattern as illustrated.

In one embodiment, there is a first rung at the first emitter end and a second rung at the second emitter end that are configured differently from the other rungs. The first rung and second rung can be separated from their adjacent rungs by larger gaps than other adjacent rungs that are separated from each other by smaller gaps. As such, the end turns can have longer bases compared to other turns. These end rungs may also be wider or have a larger cross-sectional profile.

In one embodiment, each leg extends at an angle from a corresponding turn, with the angle being relative to the planar emitter surface. That is, rather than extend from the turn such that the legs are co-planar with emitter surface, the legs are at some angle greater than 0 degrees, but less than 180 degrees, where 90 degrees provides an example. However, the angle can be determined based on the insulator block as the legs are bonded to opposite sides of the insulator block. When the insulator block has parallel opposing sides, then the legs can be at 90 degrees from the planar emitter surface. When the insulator block has opposing sides that are not parallel and are at some other angle, then that angle can be used to determine the angle of the bend of the legs away from the turns. In one aspect, each leg is substantially orthogonal with respect to the planar emitter surface. However, the legs can be co-planar with the emitter surface and be devoid of any bends.

In one embodiment, an elongate first lead leg is located at the first emitter end and an elongate second lead leg is located at the second emitter end. That is, the leg leads extend from the end rungs. The first lead leg and second lead leg can have a cross-sectional dimension that is larger than a cross-sectional dimension of the legs. Also, the first lead leg and second lead leg can have a cross-sectional dimension that is larger than a cross-sectional dimension of the rungs. Additionally, the first lead leg and second lead leg can have a cross-sectional dimension that is larger than a cross-sectional dimension of the turns or bases of the turns. The larger dimension can inhibit electron emission from the lead legs. The lead legs can be at the same angle as the legs relative to the planar emitter surface, or it can be different. The lead legs can also be coupled with the insulator block for stability. The lead legs can provide stability in a similar way as the legs. While not shown, the lead legs may also have a one or more tortuous regions.

In one embodiment, an electron emitter assembly can include an insulating member, and an electron emitter. The electron emitter can be configured as described herein. For example, the electron emitter can have an emitter body with a planar emitter surface formed by a plurality of elongate rungs connected together through a plurality of turns from a first emitter end to a second emitter end so as to form a serpentine emitter pattern. The emitter can include a plurality of elongate legs extending from the plurality of turns at an angle relative to the planar emitter surface. Each of the legs can be coupled with the insulating member.

In one embodiment, the insulating member can include an insulating block having a first block side and a second block side on opposite sides of the insulating block. The plurality of turns can include a first plurality of turns on a first emitter side of the planar emitter surface and a second plurality of turns on a second emitter side of the planar emitter surface. The first emitter side can be opposite of the second emitter side with both the first emitter side and second emitter side being between the first emitter end and second emitter end. The plurality of elongate legs can include a first plurality of elongate legs extending from the first plurality of turns and being coupled with the first block side. The plurality of elongate legs can also include a second plurality of elongate legs extending from the second plurality of turns and being coupled with the second block side.

In one embodiment, the insulating block can include one or more recesses or one or more grooves or one or more apertures or holes that receive one or more of the plurality of elongate legs. The legs may be attached to the insulating block in any way possible to provide a physical coupling that retains the legs on the insulating block. This configuration may also result in the planar emitting surface being suspended over the insulating block so that there is a gap between an insulator block surface and the planar emitter body. The distance of the gap that separates the planar emitter body and the insulator block can vary. However, the planar emitter body may be positioned to be in contact with a planar surface of the insulating block.

In one embodiment, at least one brazing can couple at least one leg with the insulating block. However, each leg can be brazed with the insulating block. The brazing can be directly attached to the insulating material of the insulator block, or a bonding pad can be located on the insulating block where the legs are brazed to the bonding pad. Other bonding, such as adhesive or welding may also be used.

In one embodiment, an elongate first lead leg can be located at the first emitter end and an elongate second lead leg can be located at the second emitter end. The first lead leg and the second lead leg are each coupled with the insulating block. Such coupling between the lead legs and insulating block can be the same or different compared to the stabilizing legs.

A cathode head can include a base and an electron emitter assembly as well as electrical leads and electrical couplers that couple the electrical leads to the electron emitter assembly. The cathode head can include an electron emitter assembly coupled with the base. The electron emitter assembly can be configured as described herein, such as by having an insulating member and an electron emitter. The insulating member can be located on the base. The electron emitter can be configured with an emitter body having a planar emitter surface formed by a plurality of elongate rungs connected together through a plurality of turns from a first emitter end to a second emitter end so as to form a serpentine emitter pattern. The emitter can have a plurality of elongate legs extending from the plurality of turns at an angle relative to the planar emitter surface. Each of the legs can be coupled with the insulating member. The emitter can include an elongate first lead leg at the first emitter end and an elongate second lead leg at the second emitter end. The insulating member can insulate the electron emitter from the base. A first electrical lead and a second electrical lead can extend from the base. A first electrical coupler can be used to couple (e.g., electronically) the first electrical lead to the first lead leg, and a second electrical coupler can be used to couple the second electrical lead to the second lead leg. In one example, at least one of the first electrical coupler or second electrical coupler is a ribbon electrical coupler.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An electron emitter comprising:

an emitter body having a planar emitter surface formed by a plurality of planar elongate rungs connected together through a plurality of planar turns from a first emitter end to a second emitter end with each turn connecting adjacent ends of two corresponding rungs so as to form a planar serpentine emitter pattern; and a plurality of elongate legs extending from the plurality of planar turns.

2. The electron emitter of claim 1, comprising at least one leg connected to each planar turn, each leg having a cross-sectional dimension smaller than a cross-sectional dimension of each of the two planar elongate rungs from which the leg extends.

3. The electron emitter of claim 1, wherein each leg includes a linker that is connected to a corresponding planar turn, each linker having a linker body with a cross-sectional dimension that is smaller than a cross-sectional dimension of each of the two planar elongate rungs from which the leg extends.

4. The electron emitter of claim 3, wherein each linker extends from at least one corner region of the corresponding turn, each corner region being formed from an intersection of a planar elongate rung and a base of a planar turn.

5. The electron emitter of claim 3, wherein each linker forms an aperture with the corresponding planar turn.

6. The electron emitter of claim 1, wherein each leg includes at least one tortuous region and at least one straight region.

7. The electron emitter of claim 1, wherein each leg includes a linker connected to a corresponding planar turn, and each leg includes a tortuous region and a straight region.

8. The electron emitter of claim 1, wherein each leg includes a linker connected to a corresponding planar turn, and each leg includes a tortuous region connected to and extending from the linker and a straight region connected to and extending from the tortuous region.

9. The electron emitter of claim 1, wherein each leg includes a linker connected to a corresponding planar turn so as to form an aperture between the linker and turn, and each leg includes at least one tortuous region and at least one straight region, wherein the at least one tortuous region is between the at least one straight region and the linker.

10. The electron emitter of claim 1, wherein each planar rung is parallel with each other planar rung, and each planar rung is separated from each other adjacent rung by a gap.

11. The electron emitter of claim 1, comprising a first planar rung at the first emitter end and a second planar rung at the second emitter end, wherein the first planar rung and second planar rung are separated from their adjacent planar rungs by larger gaps than other adjacent planar rungs that are separated from each other by smaller gaps.

12. The electron emitter of claim 1, wherein each leg extends at an angle from a corresponding planar turn, the angle being relative to the planar emitter surface.

13. The electron emitter of claim 12, wherein each leg is substantially orthogonal with respect to the planar emitter surface.

14. The electron emitter of claim 1, comprising an elongate first lead leg connected to an end rung at the first emitter end and an elongate second lead leg connected to an end rung at the second emitter end, wherein the first lead leg and second lead leg have a cross-sectional dimension that is the same or larger than a cross-sectional dimension of the rungs and larger than a cross-sectional dimension of the legs.

15. An electron emitter assembly comprising:

an insulating member; and an electron emitter with an emitter body having a planar emitter surface formed by a plurality of planar elongate rungs connected together through a plurality of planar turns from a first emitter end to a second emitter end so as to form a planar serpentine emitter pattern, and having a plurality of elongate legs extending from the plurality of planar turns at an angle relative to the planar emitter surface, each of the legs being coupled with the insulating member.

16. The electron emitter assembly of claim 15, wherein the insulating member includes an insulating block having a first block side and a second block side on opposite sides of the insulating block, wherein the plurality of planar turns includes a first plurality of planar turns on a first emitter side of the planar emitter surface and a second plurality of planar turns on a second emitter side of the planar emitter surface, the first emitter side being opposite of the second emitter side with both the first emitter side and second emitter side being between the first emitter end and second emitter end, and the plurality of elongate legs includes a first plurality of elongate legs extending from the first plurality of planar turns and being coupled with the first block side and includes a second plurality of elongate legs extending from the second plurality of planar turns and being coupled with the second block side.

17. The electron emitter assembly of claim 16, wherein the insulating block includes one or more recesses that receive one or more of the plurality of elongate legs.

18. The electron emitter assembly of claim 16, comprising at least one brazing that couples at least one leg with the insulating block.

19. The electron emitter assembly of claim 16, comprising an elongate first lead leg connected to an end rung at the first emitter end and an elongate second lead leg connected to an end rung at the second emitter end, wherein the first lead leg and second lead leg have a cross-sectional dimension that is the same or larger than a cross-sectional dimension of the rungs and larger than a cross-sectional dimension of the legs, wherein the first lead leg and the second lead leg are each coupled with the insulating block.

20. A cathode head comprising:

a base;

an electron emitter assembly coupled with the base, the electron emitter assembly including:

an insulating member on the base; and an electron emitter with an emitter body having a planar emitter surface formed by a plurality of planar elongate rungs connected together through a plurality of planar turns from a first emitter end to a second emitter end so as to form a planar serpentine emitter pattern, and having a plurality of elongate legs extending from the plurality of planar turns at an angle relative to the planar emitter surface, each of the legs being coupled with the insulating member, an elongate first lead leg at the first emitter end and an elongate second lead leg at the second emitter end, wherein the insulating member insulates the electron emitter from the base;

a first electrical lead and a second electrical lead extending from the base; and a first electrical coupler coupling the first electrical lead to the first lead leg and a second electrical coupler coupling the second electrical lead to the second lead leg.

21. The cathode head of claim 20, wherein at least one of the first electrical coupler or second electrical coupler is a ribbon electrical coupler.

* * * * *